US010381783B2

(12) United States Patent
Zhou et al.

(10) Patent No.: US 10,381,783 B2
(45) Date of Patent: Aug. 13, 2019

(54) ELECTRICAL CONNECTOR AND ELECTRICAL CONNECTOR ASSEMBLY WITH AN ASSISTING MEMBER FOR GUIDING

(71) Applicant: LOTES CO., LTD, Keelung (TW)

(72) Inventors: Kai Quan Zhou, Keelung (TW); Jun Wang, Keelung (TW); Bin Wu He, Keelung (TW); Xin Zheng Wei, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/862,775

(22) Filed: Jan. 5, 2018

(65) Prior Publication Data

US 2018/0205179 A1 Jul. 19, 2018

(30) Foreign Application Priority Data

Jan. 19, 2017 (CN) ..... 2017 2 0065942 U
Mar. 31, 2017 (CN) ..... 2017 2 0332754 U

(51) Int. Cl.
*H01R 13/6581* (2011.01)
*H01R 24/60* (2011.01)
(Continued)

(52) U.S. Cl.
CPC ..... *H01R 13/6581* (2013.01); *H01R 12/57* (2013.01); *H01R 12/79* (2013.01);
(Continued)

(58) Field of Classification Search
CPC ..... H01R 13/6581; H01R 13/6582; H01R 12/79; H01R 13/631; H01R 13/6658;
(Continued)

(56) References Cited

U.S. PATENT DOCUMENTS 5,171,161 A * 12/1992 Kachlic ..... H01R 13/6275 439/352
5,580,268 A * 12/1996 Miyazawa ..... H01R 13/6275 29/868

(Continued)

FOREIGN PATENT DOCUMENTS

CN 100536242 C 9/2009
CN 205429310 U 8/2016

(Continued)

*Primary Examiner* — Travis S Chambers
(74) *Attorney, Agent, or Firm* — Locke Lord LLP; Tim Tingkang Xia, Esq.

(57) ABSTRACT

An electrical connector assembly includes an electrical connector and a mating connector that are mutually inserted. The mating connector includes a socket and a metal shell having an insertion end protruding from the socket formed with an opening. The electrical connector includes an insulating body and an assisting member. The insulating body includes a main body and a mating portion. An upper surface of the main body is higher than that of the mating portion. An interface is formed in the front end of the main body and is positioned behind the socket. The mating portion is smaller than the opening. The assisting member covers the insulating body. A front end of the assisting member guides the insertion of the insertion end. An accommodation space is formed between the assisting member and the main body to receive only the metal shell.

23 Claims, 24 Drawing Sheets

(51) Int. Cl.

| | |
|---|---|
| ***H01R 12/57*** | (2011.01) |
| ***H01R 13/6593*** | (2011.01) |
| ***H01R 43/24*** | (2006.01) |
| ***H01R 13/66*** | (2006.01) |
| ***H01R 12/79*** | (2011.01) |
| ***H01R 13/631*** | (2006.01) |
| *H01R 12/70* | (2011.01) |
| *H01R 13/627* | (2006.01) |
| *H01R 107/00* | (2006.01) |
| *H01R 13/633* | (2006.01) |

(52) U.S. Cl.
CPC ..... *H01R 13/631* (2013.01); *H01R 13/6593* (2013.01); *H01R 13/6658* (2013.01); *H01R 24/60* (2013.01); *H01R 43/24* (2013.01); *H01R 12/707* (2013.01); *H01R 13/6275* (2013.01); *H01R 13/6335* (2013.01); *H01R 2107/00* (2013.01)

(58) Field of Classification Search
CPC .... H01R 43/24; H01R 13/6593; H01R 12/57; H01R 24/60; H01R 2107/00; H01R 13/6275; H01R 13/6335; H01R 12/707
USPC ..... 439/660, 352, 701, 95, 96, 357, 358
See application file for complete search history.

(56) References Cited

U.S. PATENT DOCUMENTS 5,718,599 A * 2/1998 Ichikawa ..... H01R 24/28 439/404
5,980,325 A * 11/1999 Horchler ..... H01R 43/20 439/660
6,354,886 B1 * 3/2002 Yu ..... H01R 13/405 439/660
7,074,070 B1 * 7/2006 Huang ..... H01R 13/6275 439/352
7,909,661 B2 * 3/2011 Wu ..... H01R 12/721 439/357
8,439,706 B2 * 5/2013 Sytsma ..... H01R 13/65802 439/607.19
8,562,369 B2 * 10/2013 Wu ..... H01R 9/032 439/345
8,834,185 B2 * 9/2014 Wu ..... H01R 9/2408 439/76.1
9,293,839 B2 * 3/2016 Nagamine ..... H01R 13/52
9,362,676 B2 * 6/2016 Puhl ..... H01R 13/6272
2010/0203772 A1 * 8/2010 Mao ..... H01R 13/502 439/701
2012/0156900 A1 * 6/2012 Wu ..... H01R 13/504 439/76.1
2015/0295357 A1 * 10/2015 Campbell ..... H01R 13/6272 439/352

FOREIGN PATENT DOCUMENTS

TW 494421 U 1/2015
TW 201541751 A 11/2015

* cited by examiner

A–A

B–B

2

100

100

100

D–D

ELECTRICAL CONNECTOR AND ELECTRICAL CONNECTOR ASSEMBLY WITH AN ASSISTING MEMBER FOR GUIDING

CROSS-REFERENCE TO RELATED APPLICATION

This non-provisional application claims priority to and benefit of, under 35 U.S.C. § 119(a), Patent Application No. 201720065942.7 filed in P.R. China on Jan. 19, 2017, and Patent Application No. 201720332754.6 filed in P.R. China on Mar. 31, 2017 the entire content of which is hereby incorporated by reference.

FIELD OF THE INVENTION

The present invention relates to an electrical connector and an electrical connector assembly, and more particularly to an electrical connector and an electrical connector assembly with an assisting member for guiding.

BACKGROUND OF THE INVENTION

A cable connector disclosed in a Chinese Patent No. 201620088903.4 is used for mating with a mating connector. The cable connector includes a mating circuit board, a cable, an insulating block and an insulating body. Multiple soldering sheets are arranged on front and rear surfaces of front and rear ends of the mating circuit board, respectively. The insulating block and the insulating body protrude forward and extend from the front end of the mating circuit board, and are configured for being inserted into the mating connector. The flat cable is soldered to the soldering sheets at the rear end of the mating circuit board, the insulating block wraps at a soldering position of the mating circuit board and the cable, and the insulating body wraps the insulating block.

The mating connector includes a mating main body, upper and lower rows of conductive terminals arranged in the mating main body in an insertion manner and a mating iron shell wrapping the mating main body. The mating iron shell includes a top wall, a bottom wall and two sidewalls which connect the top wall with the bottom wall. An opening of the mating iron shell is positioned behind the mating main body.

A mating process for the cable connector and the mating connector is that: the mating circuit board of the cable connector is inserted forward into the opening of the mating iron shell of the mating connector until the mating circuit board is clamped between the conductive terminals, and the soldering sheets of the front row of the mating circuit board are electrically connected with the conductive terminals, thereby implementing mating of the cable connector and the mating connector.

However, since only the mating circuit board is arranged at the front end of the insulating body, a gap between the mating circuit board and the opening of the mating iron shell is relatively large, and there is no guide device. When the mating circuit board is inserted forward into the opening of the mating iron shell, accurate alignment cannot be ensured due to lack of a guide device, so that the mating circuit board is very likely to be obliquely inserted into the opening of the mating iron shell to scratch the soldering sheets on the mating circuit board and the mating connector to further influence mating performance of the cable connector and the mating connector.

Therefore, a heretofore unaddressed need exists in the art to address the aforementioned deficiencies and inadequacies.

SUMMARY OF THE INVENTION

In one aspect, the present invention relates to an electrical connector with an assisting member for guiding and an electrical connector assembly.

In certain embodiments, an electrical connector assembly includes an electrical connector and a mating connector, which are mutually inserted. The mating connector includes a socket and a metal shell which covers the socket. An insertion end of the metal shell protrudes from the socket along the insertion direction thereof, and an opening is formed in the insertion end of the metal shell. The electrical connector includes an insulating body, multiple conductors, and an assisting member. The insulating body has a main body and a mating portion protruding forward from a front end of the main body. An upper surface of the main body is higher than an upper surface of the mating portion to make the front end of the main body form an interface. The interface is positioned behind the socket, and the mating portion is smaller than the opening. The multiple conductors are received in the mating portion. The assisting member covers the main body and the mating portion. A front end of the assisting member guides the insertion of the insertion end of the metal shell. A receiving space is formed between the assisting member and the mating portion to receive the socket. An accommodation space is formed between the assisting member and the main body to receive the metal shell only.

In certain embodiments, the assisting member is made from a plastic material, and is assembled on the main body or is injection molded with the main body. A guiding surface is arranged at the front end of the assisting member to guide the insertion of the insertion end of the metal shell. An inner surface of the assisting plastic member is provided with a first surface and a second surface, which are arranged stepwise. The first surface is in contact with the main body, and the accommodation space is formed between the second surface and the main body.

In certain embodiments, the assisting member is made of a metal material. The assisting member extends backward horizontally to form at least one extending arm, and the main body is correspondingly disposed with at least one protruding block covering the extending arm. Each of the at least one protruding block is recessed with a receiving slot for receiving the extending arm, and two opposite sides of the extending arm are positioned respectively at two opposite sides of the receiving slot.

In certain embodiments, the electrical connector further includes a metal latch member disposed on the main body. The metal latch member is protruded with a latch portion. A projection portion is protruded from an upper surface of the metal shell. The projection portion is provided with a buckling hole for latching the latch portion. A capping portion is protruded from the assisting member upward for covering a top surface of the projecting portion. A notch is disposed at a rear end of the capping portion to expose the latch portion.

In certain embodiments, the electrical connector is also provided with a metal latch member arranged on the main body. The metal latch member is provided with a latch portion which latch the metal shell in a protruding manner. The assisting member is provided with a top wall and a bottom wall, which are opposite to each other, as well as two opposite sidewalls which connect the top wall with the bottom wall. The top wall is provided with an open hole which exposes the latch portion.

In certain embodiments, a projecting portion is arranged on an upper surface of the metal shell in the protruding manner. The projecting portion is provided with a buckling hole configured to latch the latch portion. Two opposite side edges of the open hole are positioned on two opposite sides of the projecting portion. A guide portion is arranged at a front end of the open hole to guide the projecting portion to enter the open hole to be further latched with the metal latch member.

In certain embodiments, a front end of the mating portion protrudes forward out of the front end of the assisting member. The projecting portion bends downward and extends backward to form a first urging portion. The first urging portion bends upward and extends backward to form a second urging portion. The first urging portion and the second urging portion urge an upper surface of the socket, and the front end of the assisting member is stopped at a bending portion where the second urging portion is connected with the first urging portion.

In certain embodiments, the metal latch member is provided with a pressing portion which is upward suspended over the insulating body. The open hole penetrates through front and rear ends of the top wall. The two opposite side edges of the open hole upward extend to form two connecting portions. At least one covering portion is connected with at least one of the two connecting portions. The covering portion upward covers the pressing portion.

In certain embodiments, the covering portion comprises two covering portions respectively connected with the two connecting portions, a notch is formed between the two covering portions, and the notch extends to front and rear ends of the two covering portions.

In certain embodiments, the two opposite side edges of the open hole extend upward towards opposite directions to form the two connecting portions.

In certain embodiments, cables are arranged at a rear end of the main body. The rear end of each sidewall or the top wall or the bottom wall extends backward to form a hook portion. The hook portion is hooked and buckled to the rear end of the main body.

In certain embodiments, a stopping surface is arranged on each of two opposite sides of the main body to stop the insertion end of the metal shell. A positioning block protrudes forward and extends from each stopping surface. The insertion end of the metal shell is recessed with two recesses, and the two positioning blocks are buckled to the two recesses respectively. The assisting member is provided with two opposite sidewalls. A blocking portion is arranged on an inner surface of each sidewall, and the blocking portions are stopped at the stopping surfaces.

In certain embodiments, a rear end of each blocking portion is recessed with a positioning slot, and the positioning blocks are engaged with the positioning slots.

In another aspect, the present invention relates to an electrical connector for mating with a mating connector. In certain embodiments, the mating connector includes a socket and a metal shell which covers the socket. The electrical connector includes an insulating body, a metal latch member, multiple conductors, multiple cables, and an assisting plastic member. The insulating body has a main body and a mating portion protruding forward from a front end of the main body. An upper surface of the main body is higher than an upper surface of the mating portion to make the front end of the main body form an interface. The metal latch member is mounted on the main body and provided with a latch portion configured to latch the metal shell. The conductors are received in the mating portion respectively. The cables protrude backward from a rear end of the main body and are electrically connected with the conductors. The assisting plastic member covers the main body and the mating portion. A guiding surface configured to guide the metal shell is arranged at a front end of the assisting plastic member. A receiving space is formed between the assisting plastic member and the mating portion to receive the socket. An inner surface of the assisting plastic member is provided with a first surface and a second surface, which are arranged stepwise. The first surface is in contact with the main body. An accommodation space configured to receive the metal shell only is formed between the second surface and the main body. The receiving space and the accommodation space are positioned on front and rear sides of the interface.

In certain embodiments, the assisting plastic member is also provided with a top wall and a bottom wall, which are arranged opposite to each other, as well as two opposite sidewalls which connect the top wall with the bottom wall, and the top wall is provided with an open hole which exposes the latch portions.

In certain embodiments, a protruding portion is arranged on the upper surface of the main body in a protruding manner, the metal latch member is mounted on the protruding portion, two opposite side edges of the open hole are positioned on two opposite sides of the protruding portion, and a guide portion is arranged at a front end of the open hole.

In certain embodiments, the metal latch member is provided with a pressing portion which is upward suspended over the insulating body. The open hole penetrates through front and rear ends of the top wall, the two opposite side edges of the open hole extend upward to form two connecting portions, at least one covering portion is connected with at least one of the two connecting portions, and the at least one covering portion upwards covers the pressing portion.

In certain embodiments, the at least one covering portion comprises two covering portions respectively connected with the two connecting portions, a notch is formed between the two covering portions, and the notch extends to front and rear ends of the two covering portions.

In certain embodiments, the two opposite side edges of the open hole upwards extend towards opposite directions to form the two connecting portions. In certain embodiments, a stopping surface configured to stop an insertion end of the metal shell is arranged on each of two opposite sides of the main body, and a positioning block configured to buckle the metal shell protrudes forward and extends from each stopping surface. The assisting plastic member is provided with two opposite sidewalls. A blocking portion is arranged on an inner surface of each sidewall, and the blocking portions are stopped at the stopping surfaces.

In certain embodiments, a rear end of the assisting plastic member extends backward to form a hook portion, and the hook portion is hooked and buckled to the rear end of the main body.

In certain embodiments, a front end of the mating portion protrudes forward from the front end of the assisting plastic member.

In certain embodiments, a projection portion is protruded from an upper surface of the metal shell. The projection portion is provided with a buckling hole for latching the latch portion. A capping portion is protruded from the assisting plastic member upward for covering a top surface of the projecting portion. A notch is disposed at the rear end of the capping portion to expose the latch portion.

Compared with the related art, the electrical connector and the electrical connector assembly according to certain embodiments of the present invention have the following beneficial advantages:

The assisting member is added to cover the main body and the mating portion, and the front end of the assisting member guides the mating connector, so that scratches and damages to the conductors and the mating connector caused by inaccurate alignment of the mating portion of the electrical connector can be effectively reduced, not only is service life of the electrical connector prolonged, but also mating performance of the electrical connector assembly is improved, and the electrical connector assembly is more consistent with a requirement of a user.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
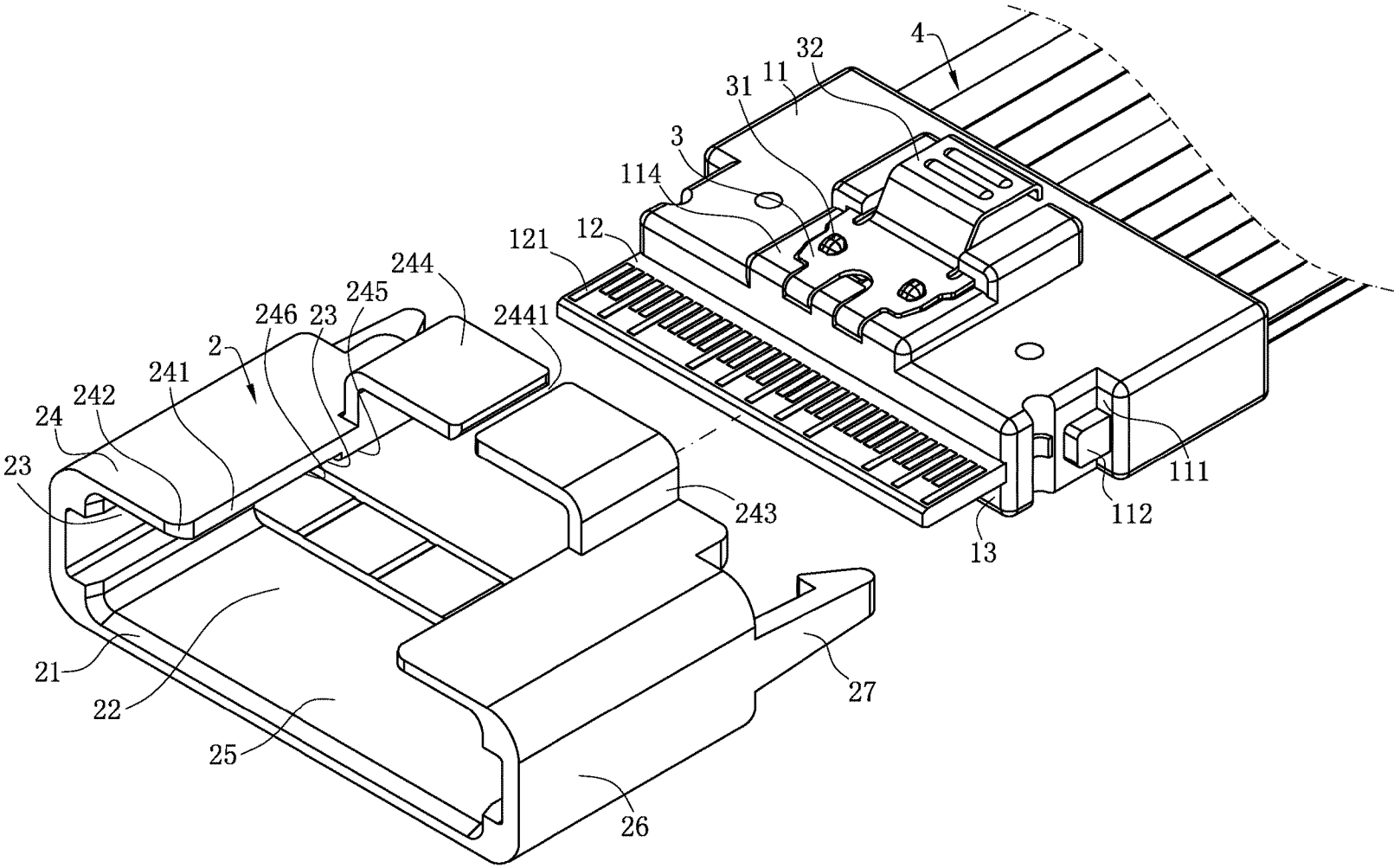
FIG. 1 is a schematic three-dimensional exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector and an electrical connector assembly.

Figure 2:
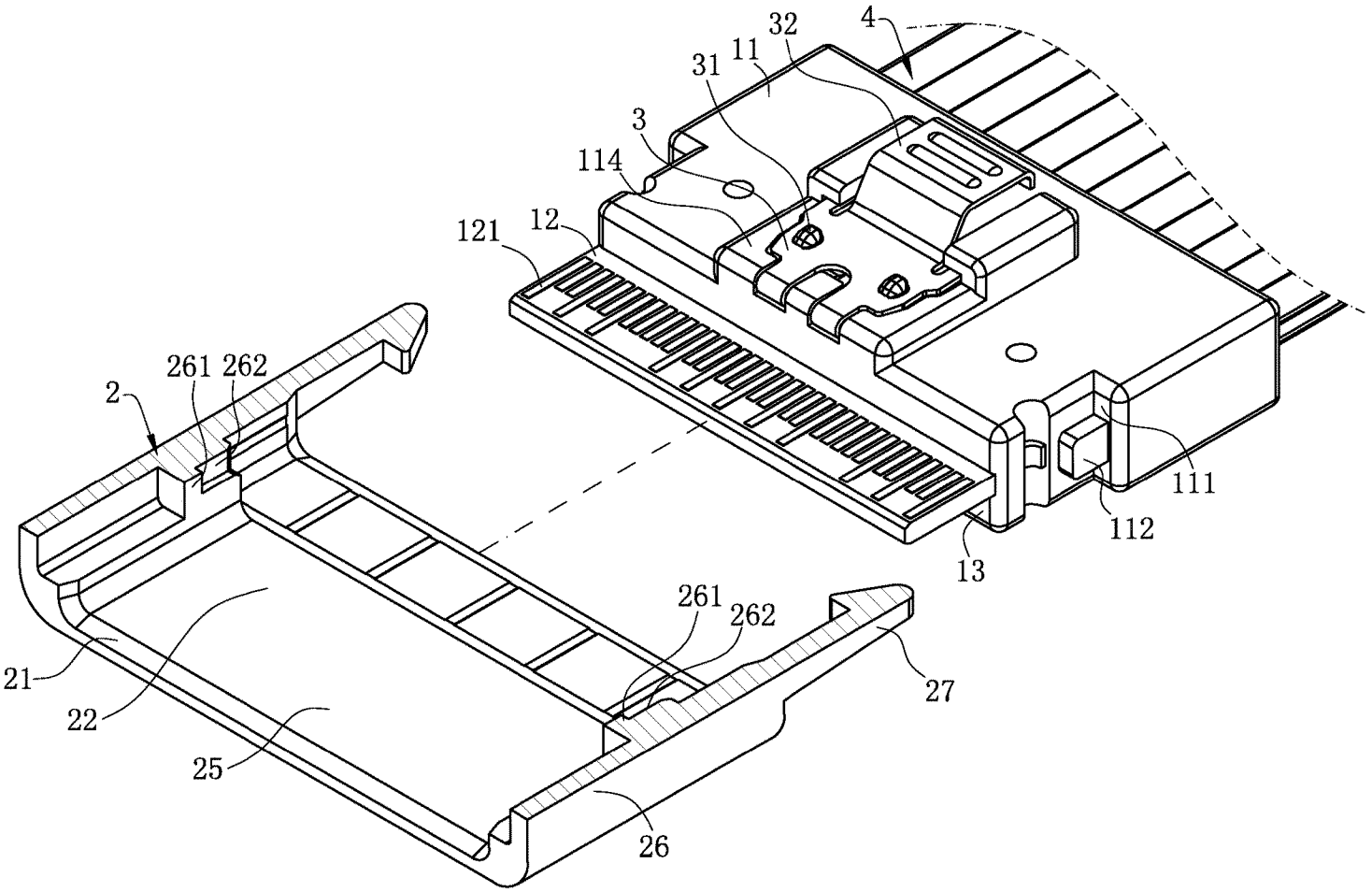
FIG. 2 is a partial sectional view of an assisting member in FIG. 1.
Figure 3:
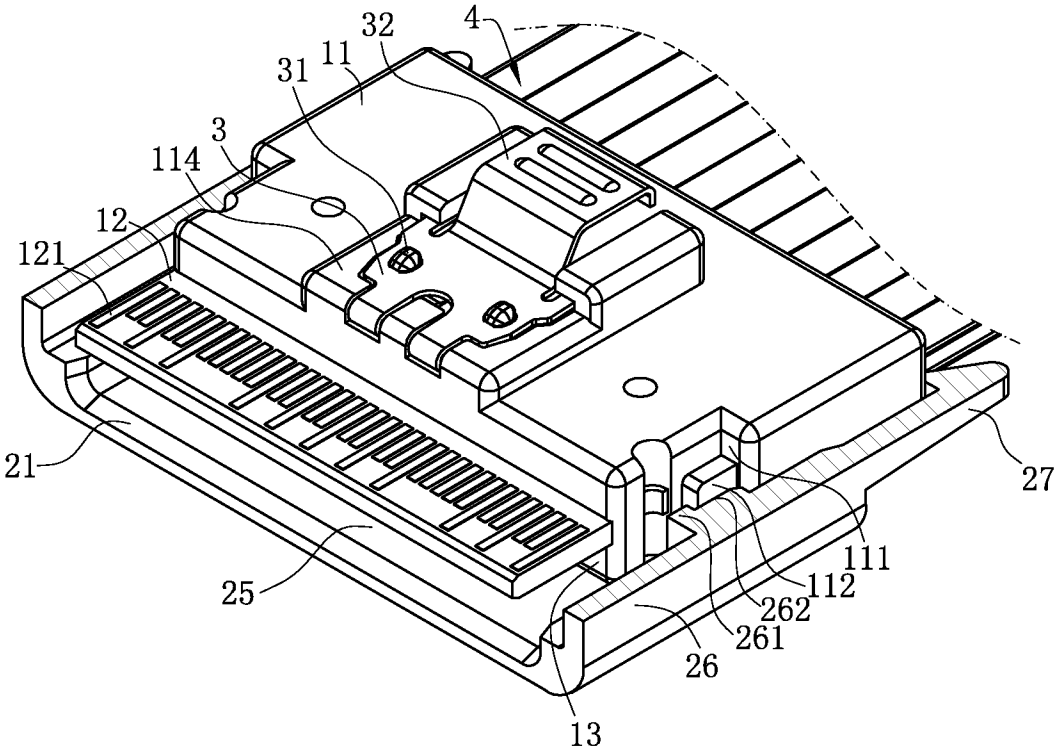
FIG. 3 is an assembled view of FIG. 2.
Figure 4:
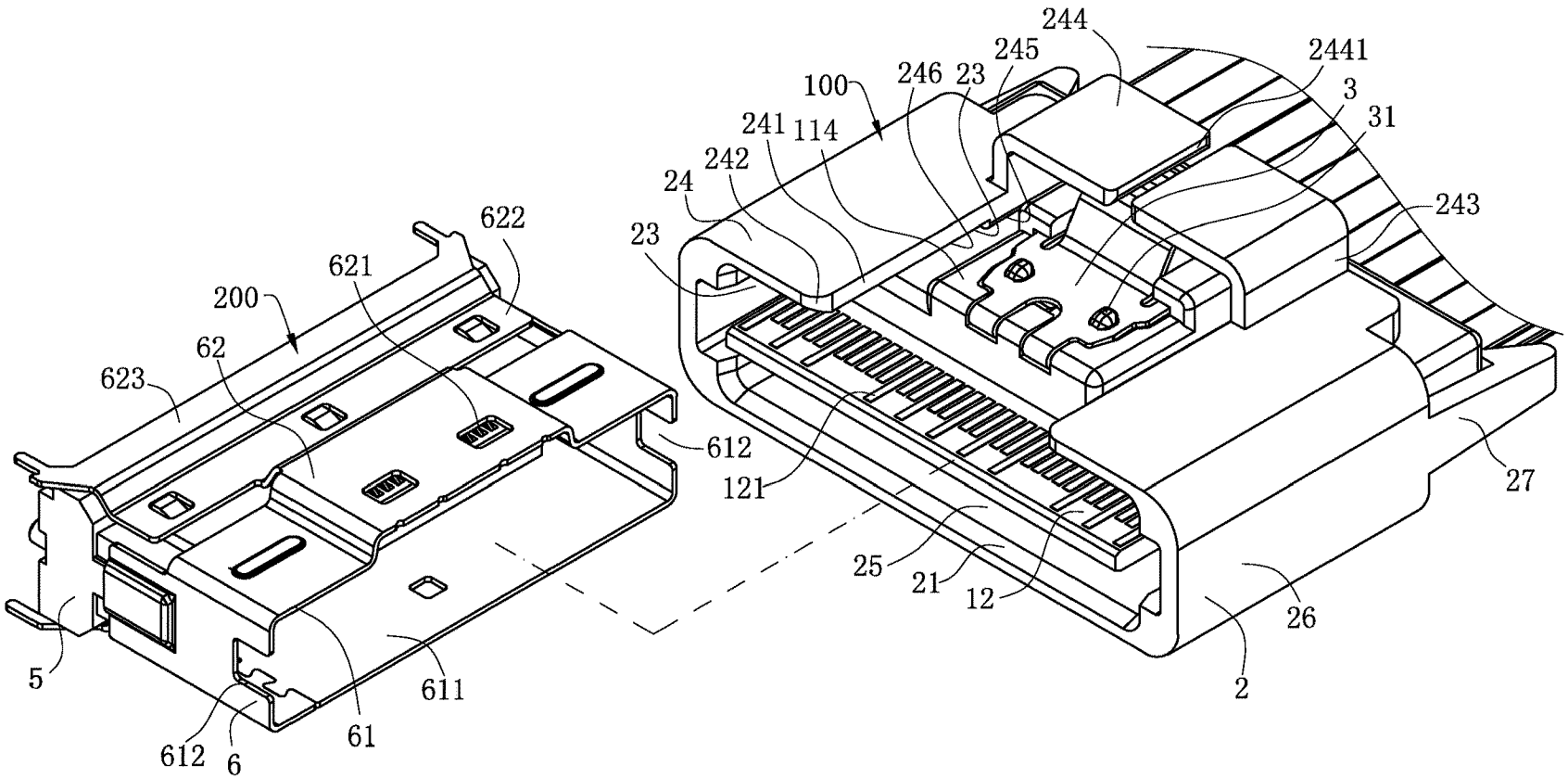
FIG. 4 is a schematic three-dimensional view of an electrical connector assembly according to the first embodiment of the present invention.
Figure 5:
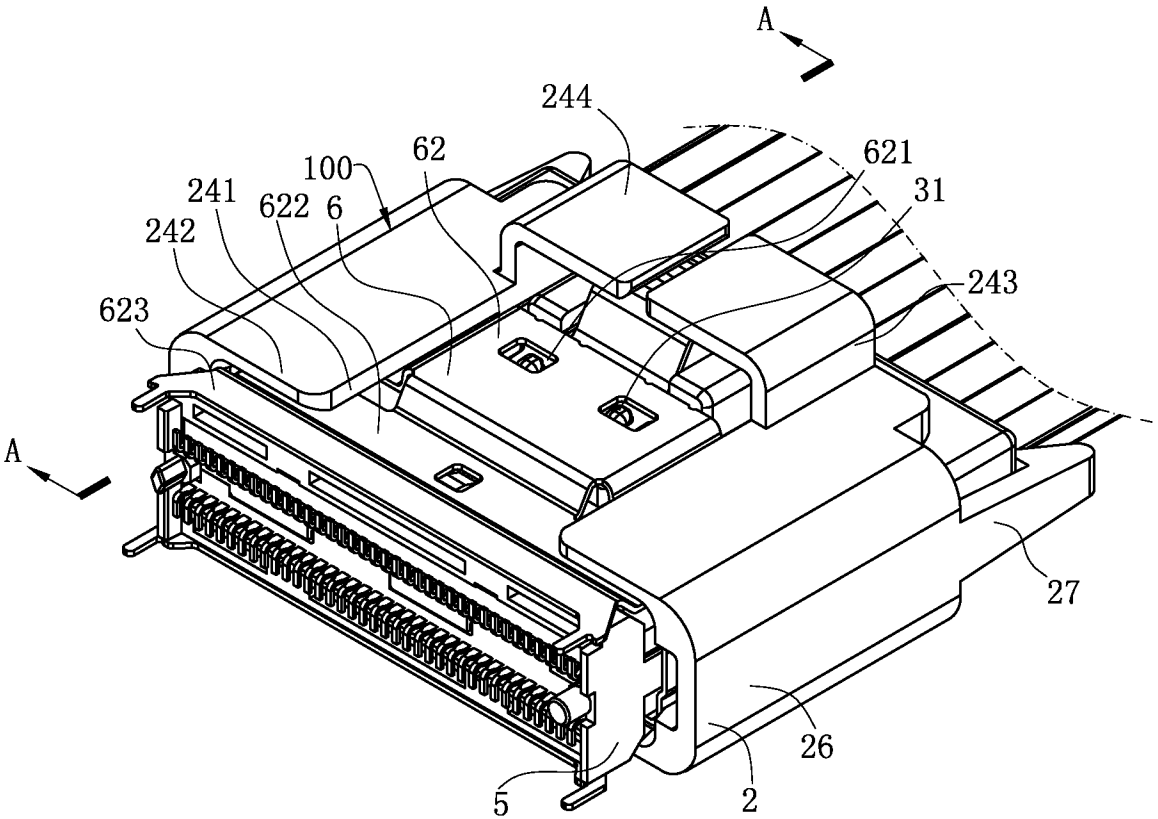
FIG. 5 is a schematic three-dimensional view of FIG. 4 after assembling of the electrical connector assembly.
Figure 6:
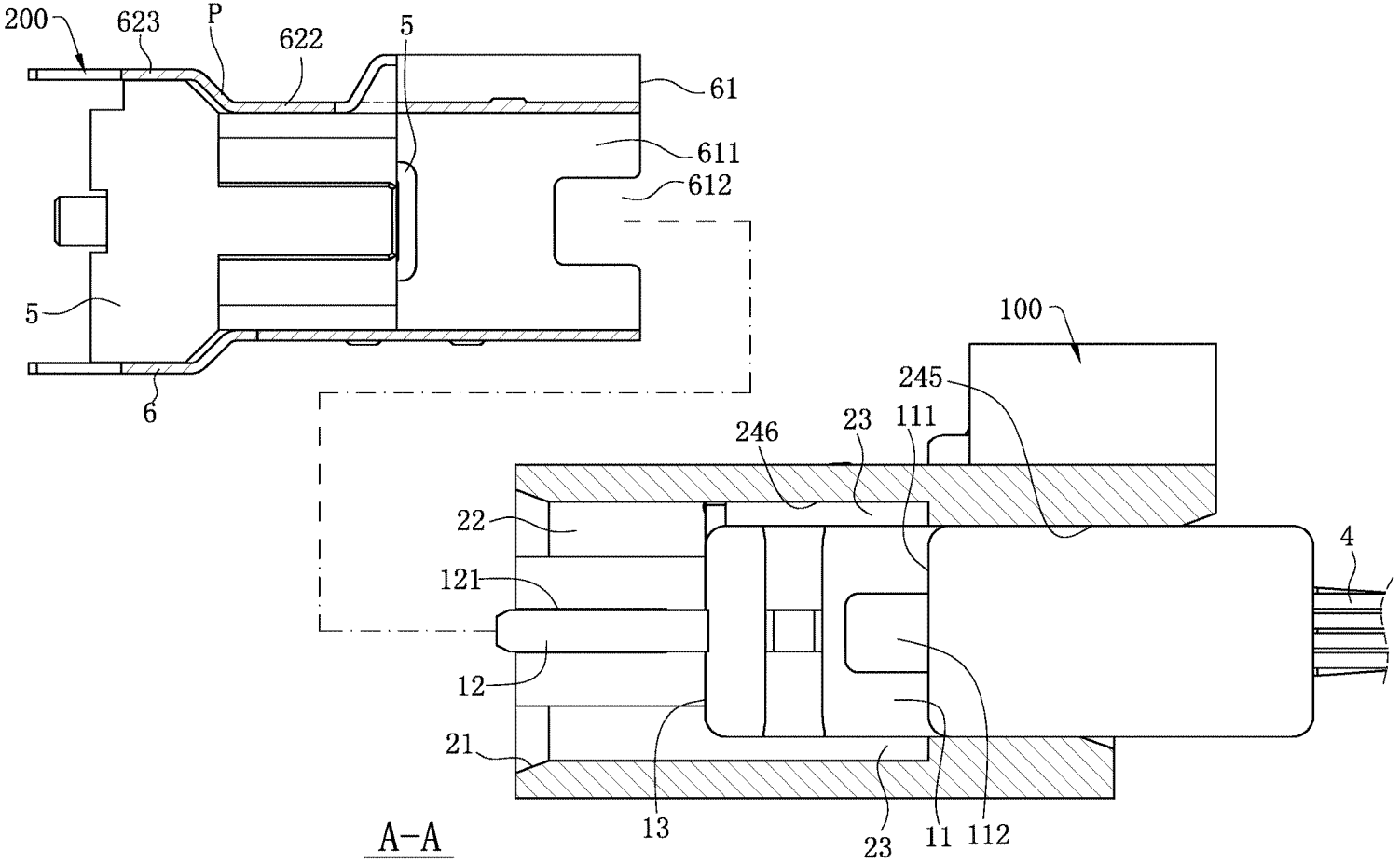
FIG. 6 is a sectional view of FIG. 4 before assembling of the electrical connector assembly along A-A.
Figure 7:
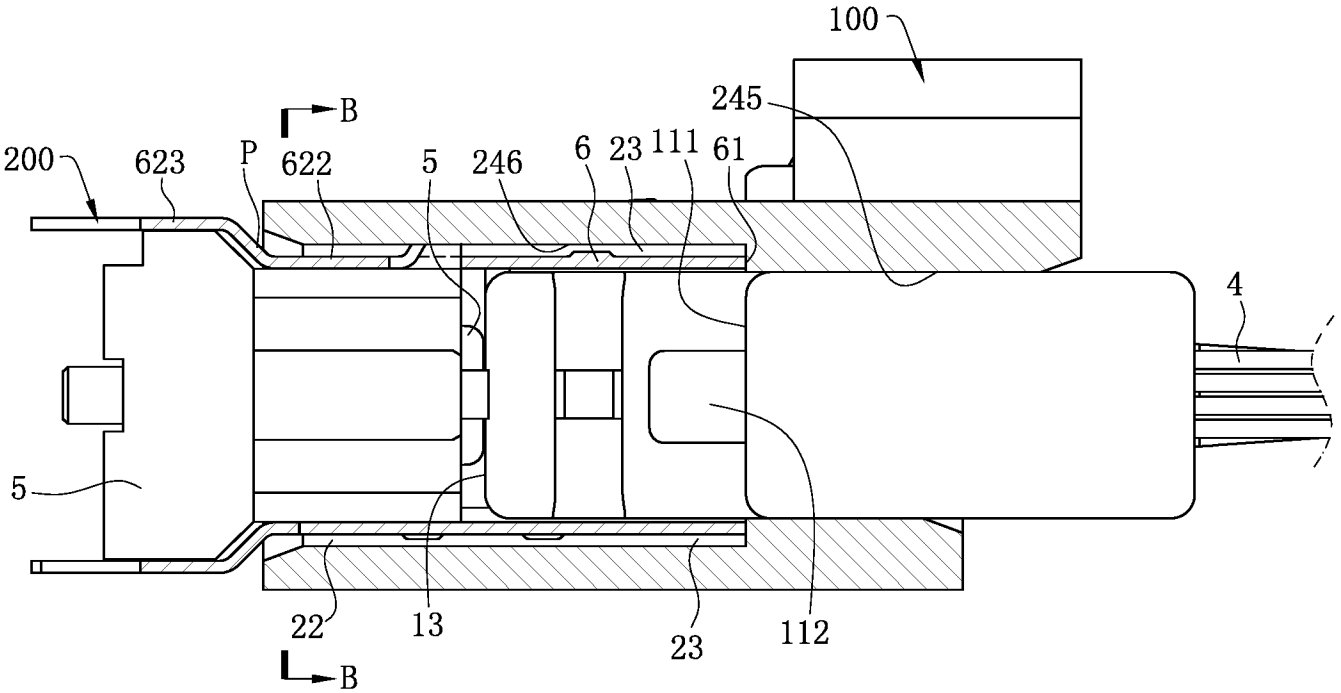
FIG. 7 is a sectional view of FIG. 4 after assembling of the electrical connector assembly along A-A.
Figure 8:
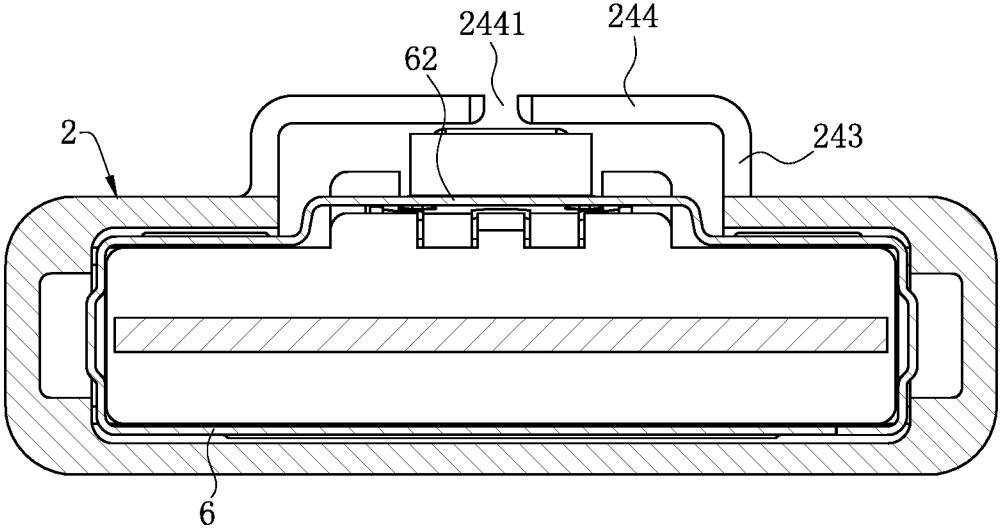
FIG. 8 is a sectional view of FIG. 7 along B-B.

FIGS. 1-8 show an electrical connector 100 and an electrical connector assembly of a first embodiment of the present invention. As shown in FIG. 4, the electrical connector assembly includes the electrical connector 100 and a mating connector 200, which are mutually inserted. The electrical connector 100 includes an insulating body 1, multiple conductors 121 received in the insulating body 1 and an assisting member 2 covering the insulating body 1. The mating connector 200 includes a socket 5 and a metal shell 6 which covers the socket 5.

As shown in FIGS. 1 and 2, the insulating body 1 is provided with a main body 11 and a mating portion 12 which protrudes forward from a front end of the main body 11. An upper surface of the main body 11 is higher than an upper surface of the mating portion 12 to make the front end of the main body 11 form an interface 13. The interface 13 is positioned behind the socket 5, and the conductors 121 are received in the mating portion 12.

The electrical connector 100 is also provided with a metal latch member 3 and multiple cables 4. A protruding portion 114 is arranged on the upper surface of the main body 11 in a protruding manner. The metal latch member 3 is arranged on the protruding portion 114. The metal latch member 3 is provided with two latch portions 31 configured to latch the metal shell 6 in the protruding manner. In the present embodiment, there are two latch portions 31. In another embodiment, there can be one latch portion 31, which is arranged at the central position of the metal latch member 3. The metal latch member 3 is also provided with a pressing portion 32 which is upward suspended over the insulating body 1. The cables 4 protrude backward from a rear end of the main body 11, and are electrically connected with the conductors 121.

As shown in FIGS. 3-8, the assisting member 2 (which can be also called an assisting plastic member) is made from a plastic material, is assembled on the main body 11 of the insulating body 1 and covers the main body 11 and the mating portion 12. A receiving space 22 configured to receive the socket 5 is formed between the assisting member 2 and the mating portion 12. A front end of the mating portion 12 protrudes forward from a front end of the assisting member 2, and the front end of the assisting member 2 is stopped at the metal shell 6. The assisting member 2 is provided with a top wall 24 and a bottom wall 25, which are opposite to each other, as well as two sidewalls 26 which connect the top wall 24 with the bottom wall 25.

The top wall 24 covers a part above the main body 11 and the mating portion 12. An inner surface of the top wall 24 is provided with a first surface 245 and a second surface 246, which are arranged stepwise. The second surface 246 is higher than the first surface 245. The first surface 245 is in contact with the main body 11. An accommodation space 23 configured to receive the metal shell 6 only is formed between the second surface 246 and the main body 11, and the receiving space 22 and the accommodation space 23 are positioned on front and rear sides of the interface 13. The top wall 24 is provided with an open hole 241 which exposes the latch portions 31. Two opposite side edges of the open hole 241 are positioned on two opposite sides of a projecting portion 62 and the protruding portion 114. A guide portion 242 is arranged at a front end of the open hole 241 to guide the projecting portion 62 to enter an opening 611 to be further latched with the metal latch member 3. Two opposite edges of the open hole 241 extend upward to form two connecting portions 243. At least one covering portion 244 is connected with at least one of the two connecting portions 243. In the present embodiment, the covering portion 244 comprises two covering portions 244 respectively connected with the two connecting portions 243, each covering portion 244 is perpendicular to the connecting portions 243, and each covering portion 244 upward covers the pressing portion 32. A notch 2441 is formed between the two covering portions 244, the notch 2441 extends to front and rear ends of the covering portions 244, and the notch 2441 is positioned above the pressing portion 32. A rear end of each sidewall 26 extends backward to form a hook portion 27, and the hook portion 27 is hooked and buckled to the rear end of the main body 11, which can prevent the assisting member 2 from being unplugged together due to infirm retaining with the insulating body 1 when the mating connector 200 is unplugged.

As shown in FIGS. 4-7, the metal shell 6 is provided with an insertion end 61 which protrudes from the socket 5 along the insertion direction thereof. The opening 611 is formed in the insertion end 61 of the metal shell 6. A length of the opening 611 is larger than a length of the mating portion 12, and a width of the opening 611 is larger than a width of the mating portion 12. A guiding surface 21 configured to guide the insertion end 61 of the metal shell 6 is arranged at the front end of the assisting member 2. A projecting portion 62 is arranged on an upper surface of the metal shell 6 in the protruding manner. The projecting portion 62 is provided with two buckling holes 621 configured to latch the two latch portions 31. In the present embodiment, there are two buckling holes 621. In another embodiment, there can be one buckling hole 621, which is arranged at the central position of the projecting portion 62.

The projecting portion 62 bends downward and extends backward to form a first urging portion 622. The first urging portion 622 bends upward and extends backward to form a second urging portion 623. The first urging portion 622 and the second urging portion 623 urge an upper surface of the socket 5. When the mating connector 200 is mated with the electrical connector 100, the front end of the assisting member 2 is stopped at a bending position P where the second urging portion 623 is connected with the first urging portion 622, so that damage to the mating connector 200 caused by excessive insertion can be effectively avoided.

As shown in FIGS. 2 and 3, a stopping surface 111 is arranged on each of two opposite sides of the main body 11 to stop the insertion end 61. A positioning block 112 forward protrudes and extends from the stopping surface 111. The insertion end 61 is recessed with two recesses 612. The positioning blocks 112 are buckled to the two recesses 612 respectively. A blocking portion 261 is arranged on an inner surface of each sidewall 26, the blocking portions 261 are stopped at the stopping surfaces 111, and a positioning slot 262 configured to receive the corresponding positioning block 112 is formed in a rear end of each blocking portion 261.

Figure 9:
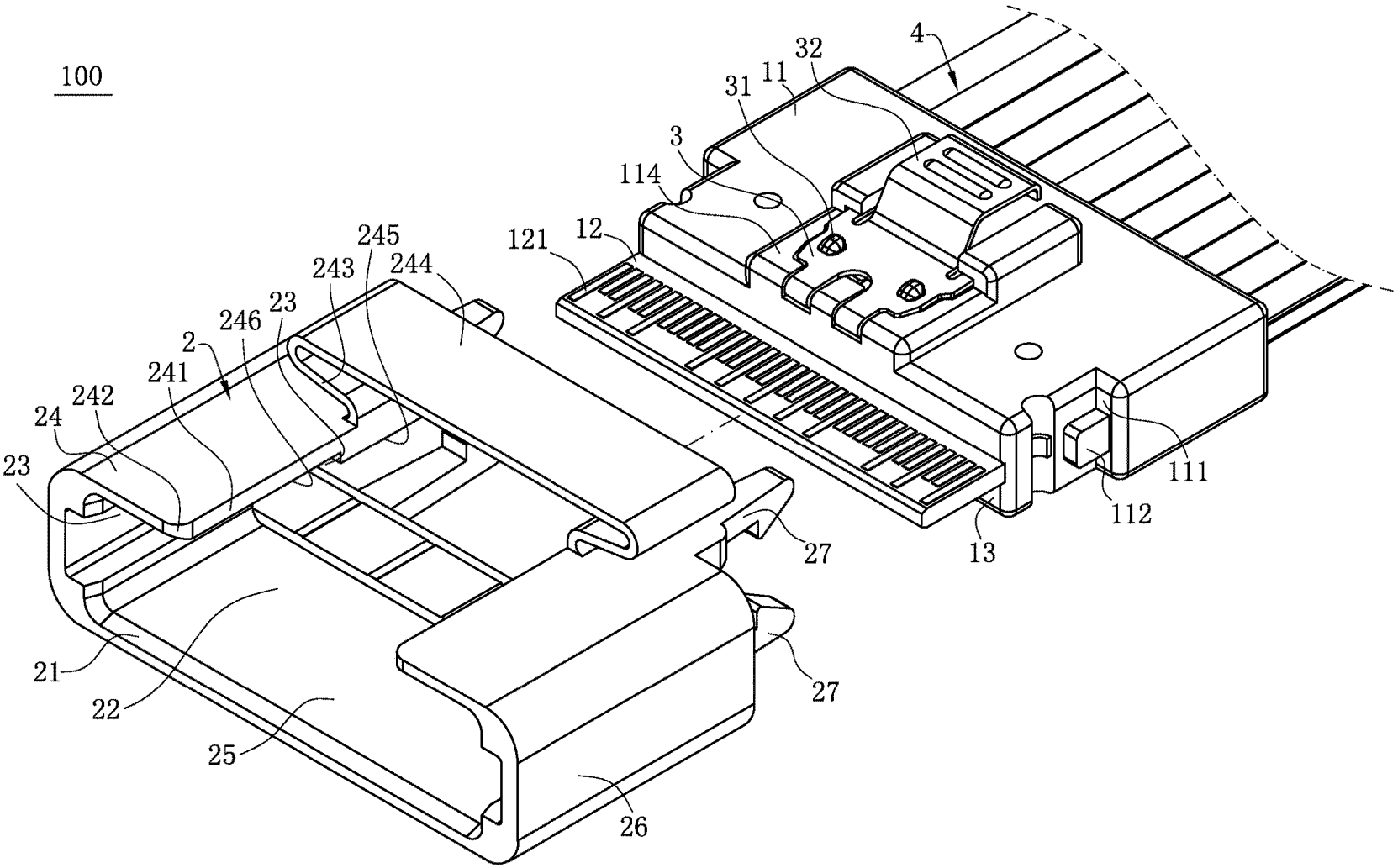
FIG. 9 is a schematic three-dimensional exploded view of an electrical connector according to a second embodiment of the present invention.
Figure 10:
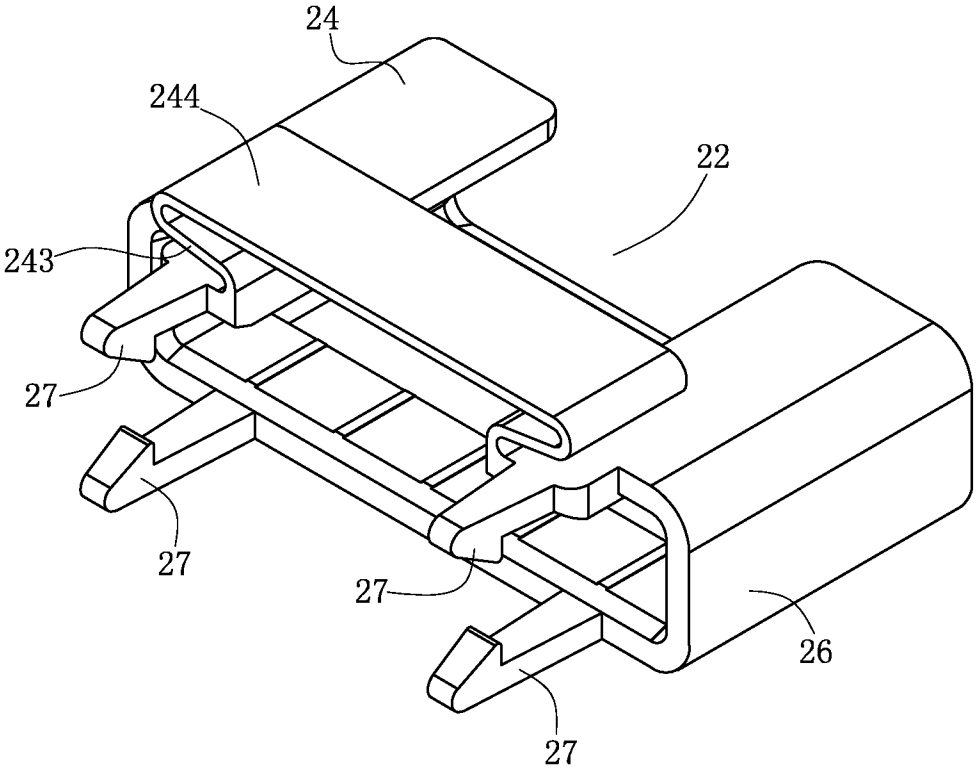
FIG. 10 is a view of the assisting member in FIG. 9 after 180° rotation.
Figure 11:
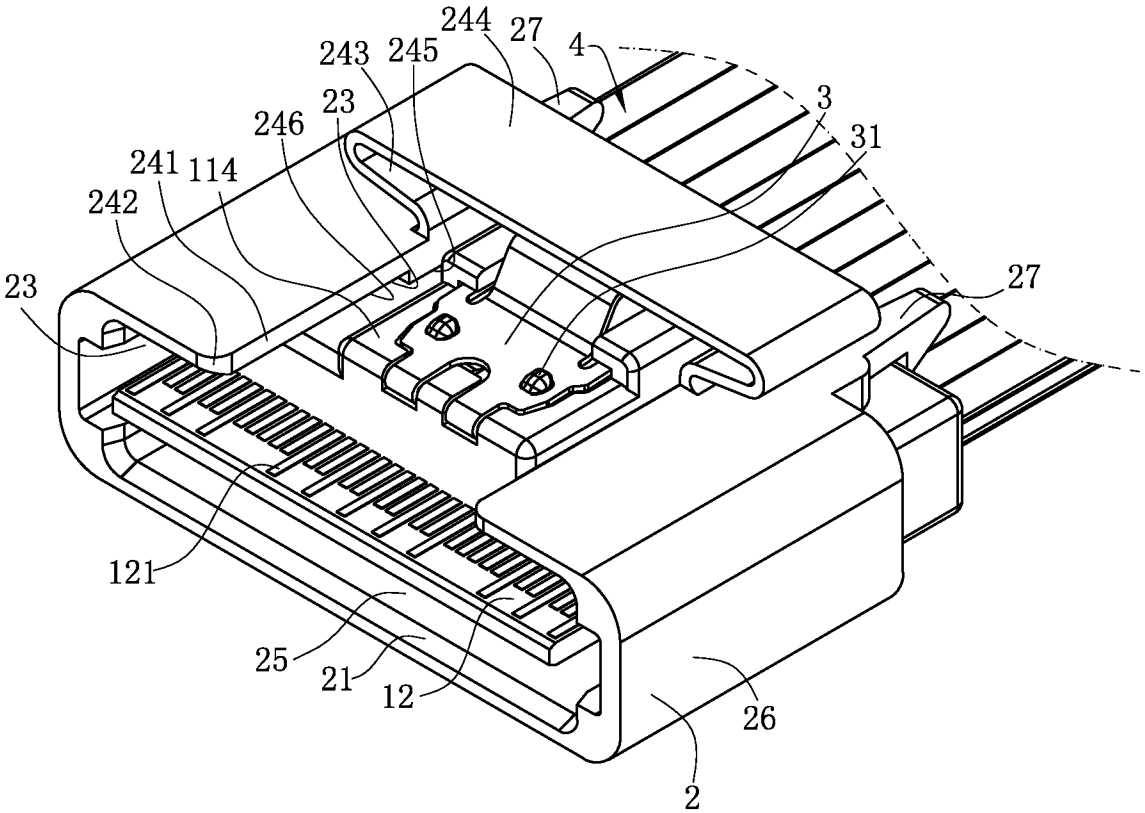
FIG. 11 is a schematic three-dimensional assembly view of FIG. 9.

FIGS. 9-11 show an electrical connector 100 of a second embodiment of the present invention. A difference from the first embodiment is mainly that: only one covering portion 244 is provided to be connected with the two connecting portions 243, the two connecting portions 243 are formed by upward bending and extension from the two opposite edges of the open hole 241 towards opposite directions, so that elasticity of the covering portion 244 is further enhanced. The hook portions 27 are formed by backward extension from rear ends of the top wall 24 and the bottom wall 25.

Figure 12:
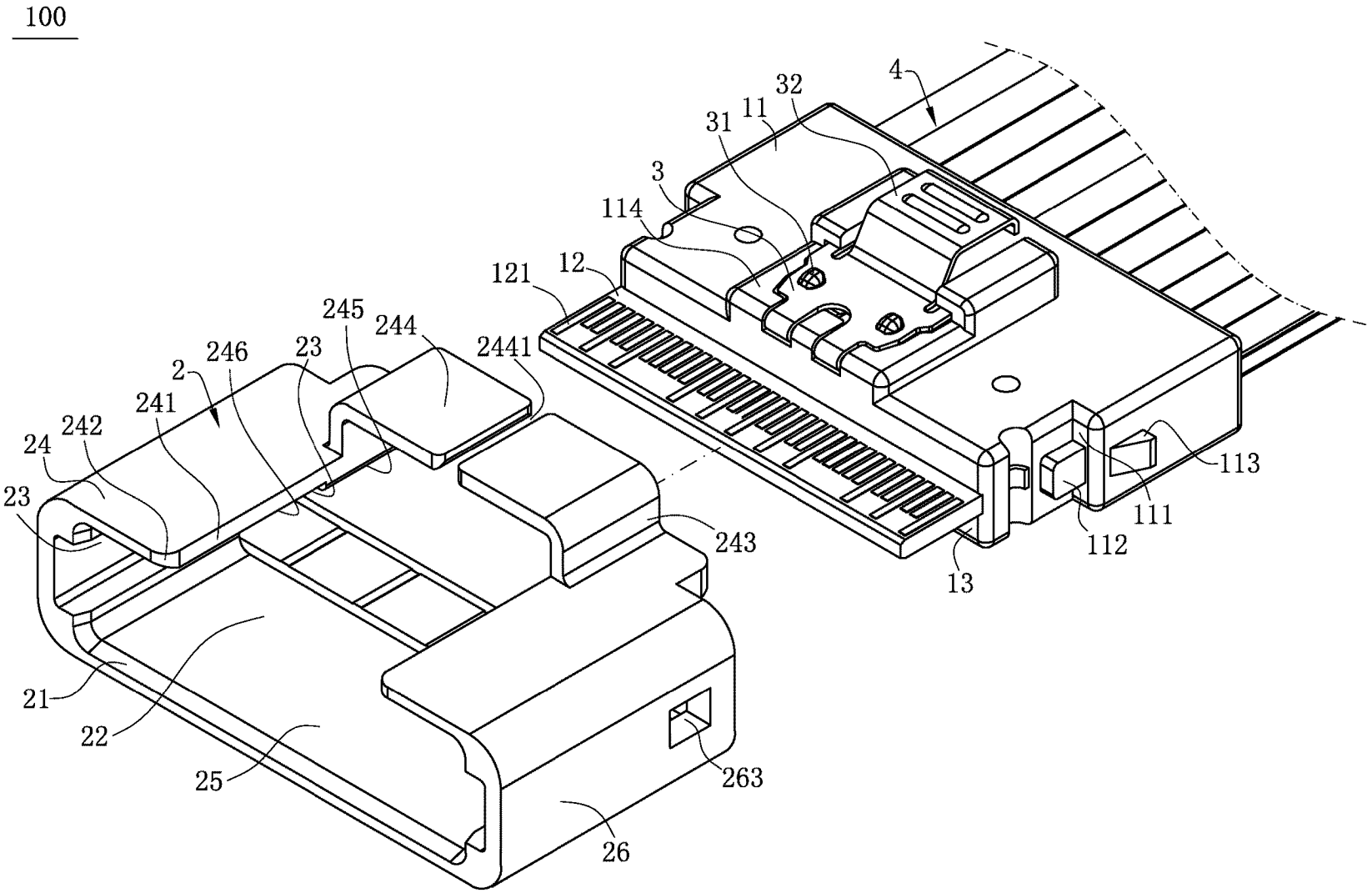
FIG. 12 is a schematic three-dimensional exploded view of an electrical connector according to a third embodiment of the present invention.
Figure 13:
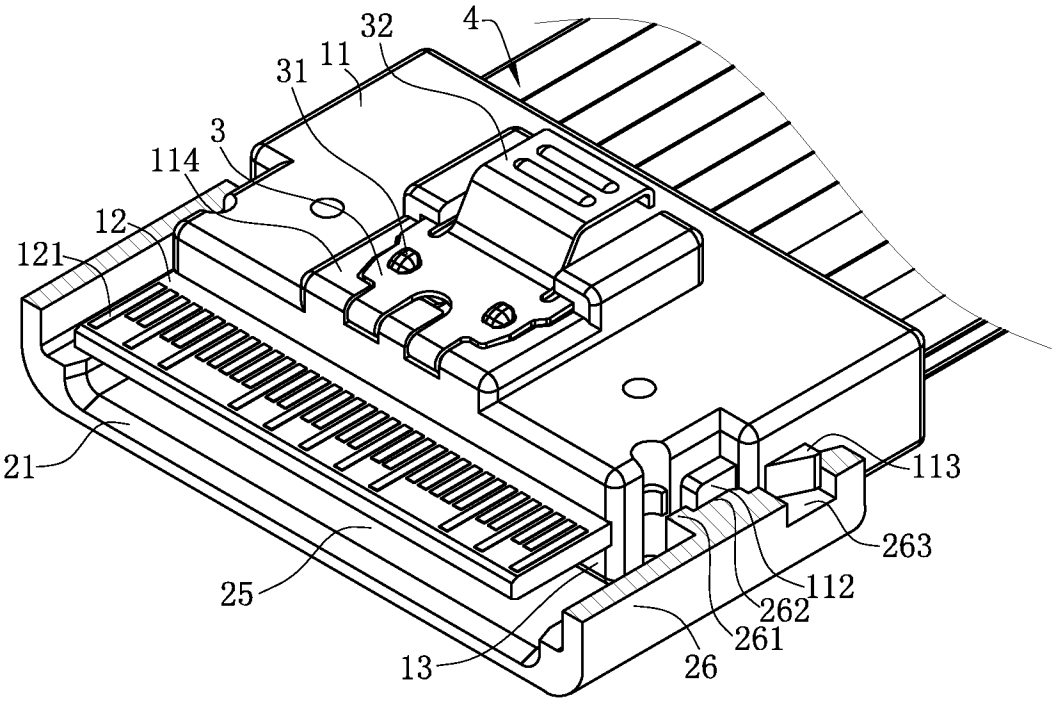
FIG. 13 is a three-dimensional assembly partial sectional view of FIG. 12.

FIGS. 12 and 13 show an electrical connector 100 of a third embodiment of the present invention. A difference from the first embodiment is mainly that: a groove 263 is formed in the rear end of each sidewall 26, the grooves 263 are positioned behind the blocking portions 261, and an engagement block 113 which is matched and retained with the corresponding groove 263 is arranged on each of the two opposite sides of the main body 11.

Figure 14:
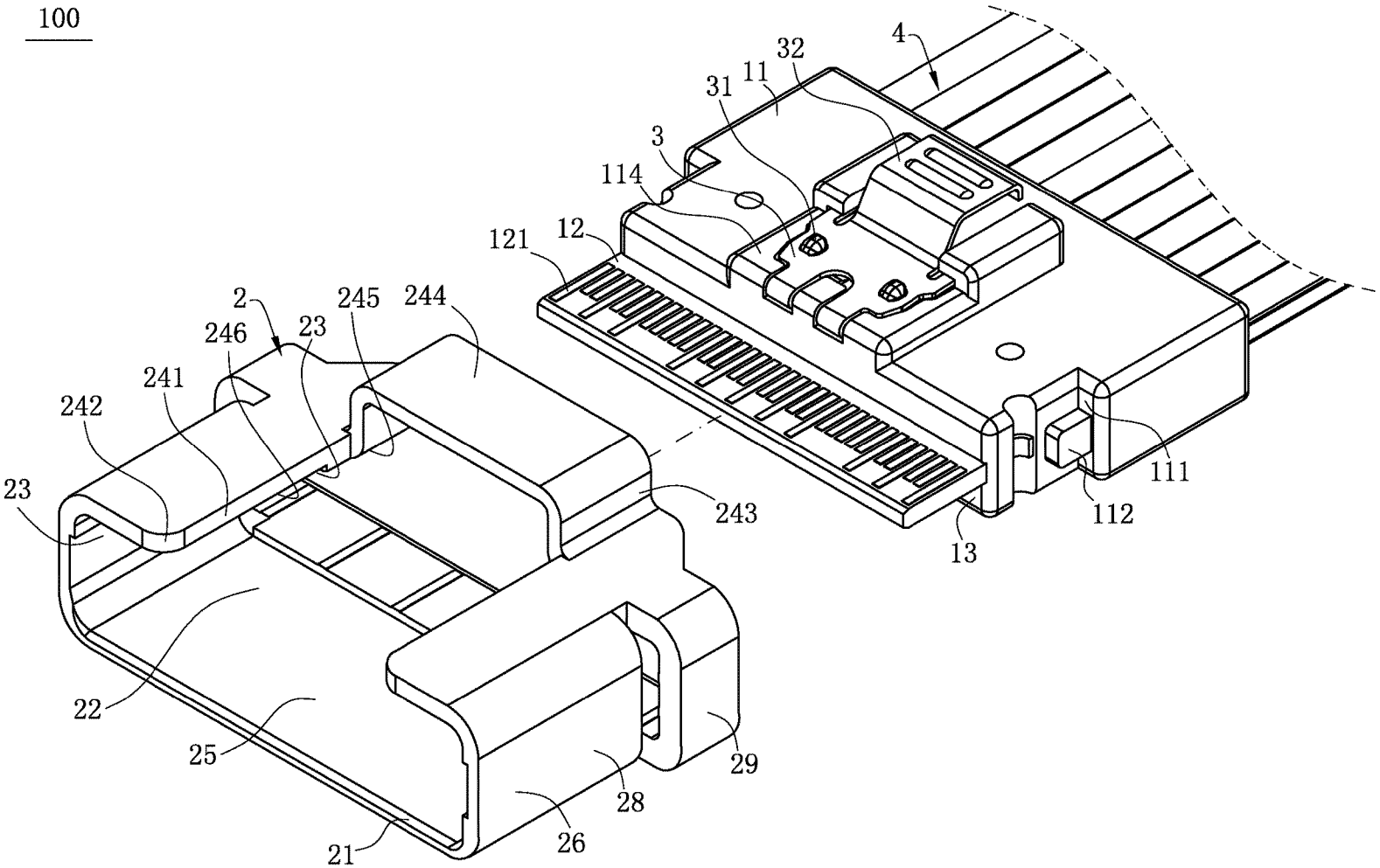
FIG. 14 is a schematic three-dimensional exploded view of an electrical connector according to a fourth embodiment of the present invention.
Figure 15:
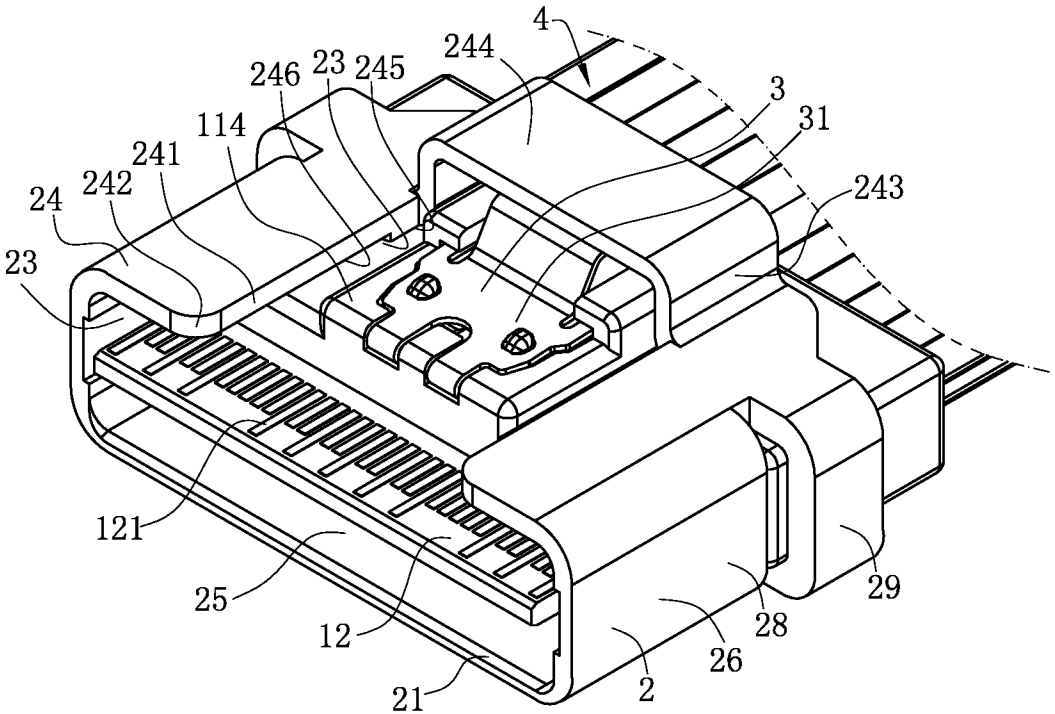
FIG. 15 is a schematic three-dimensional assembly view of FIG. 14.

FIGS. 14 and 15 show an electrical connector 100 of a fourth embodiment of the present invention. A difference from the first embodiment is mainly that: the assisting member 2 is provided with a front portion 28 and a rear portion 29 which is positioned at a rear end of the front portion 28, the front portion 28 is connected with the rear portion 29, a length of the front portion 28 is smaller than a length of the rear portion 29, and the rear portion 29 forms interference fit with the main body 11 to fixedly mount the assisting member 2 on the main body 11.

Figure 16:
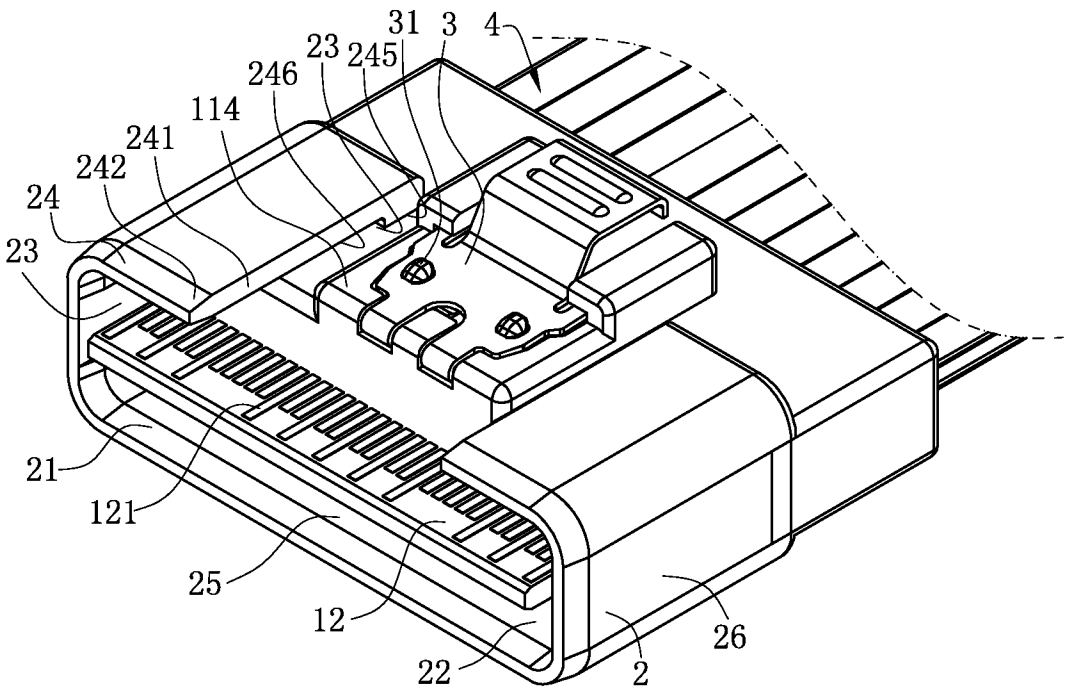
FIG. 16 is a three-dimensional assembly view of an electrical connector according to a fifth embodiment of the present invention.

FIG. 16 shows an electrical connector 100 of a fifth embodiment of the present invention. A difference from the first embodiment is mainly that: the assisting member 2 is injection molded with the main body 11.

Figure 17:
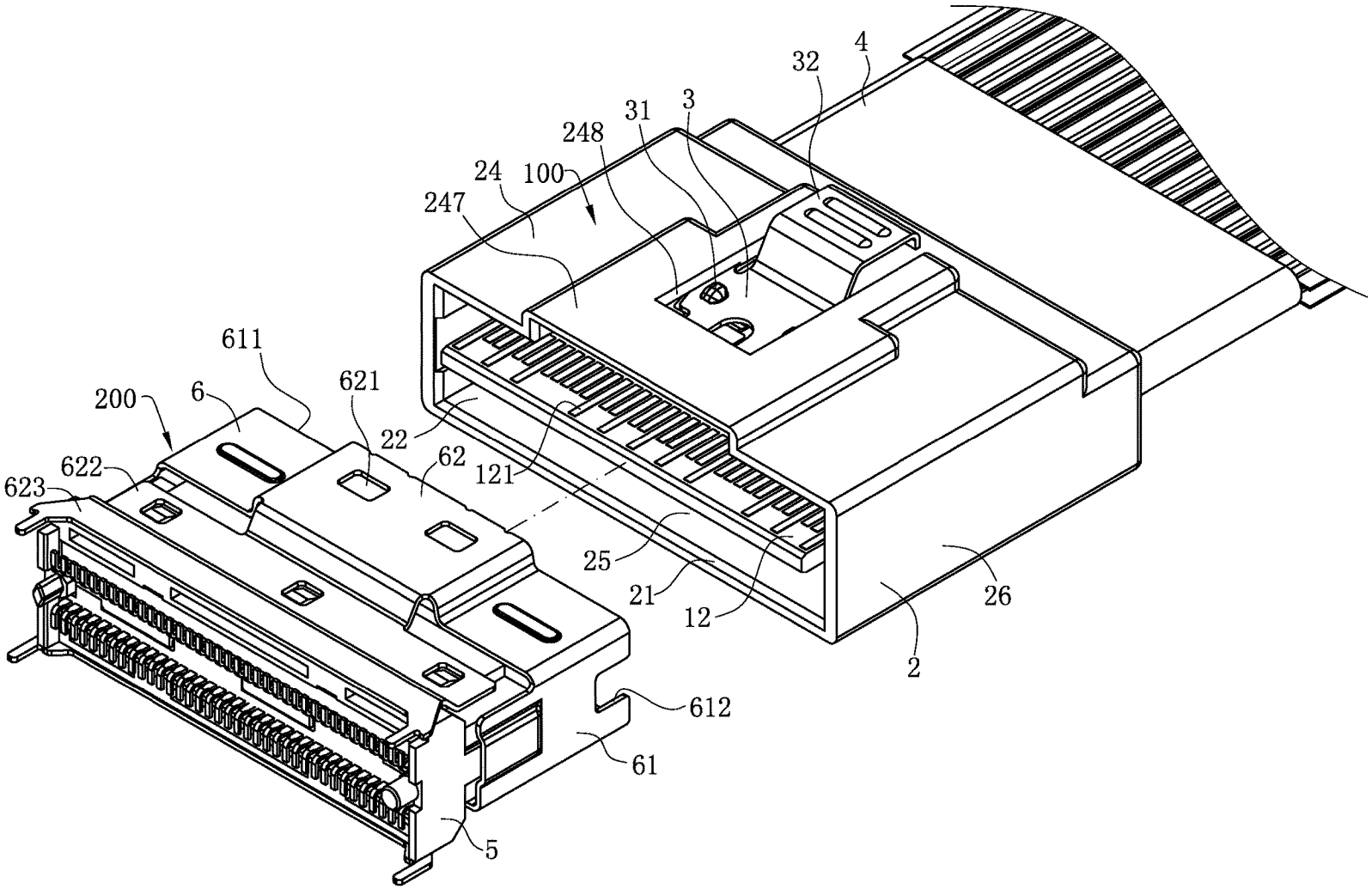
FIG. 17 is a schematic three-dimensional view of an electrical connector assembly according to a sixth embodiment of the present invention.
Figure 18:
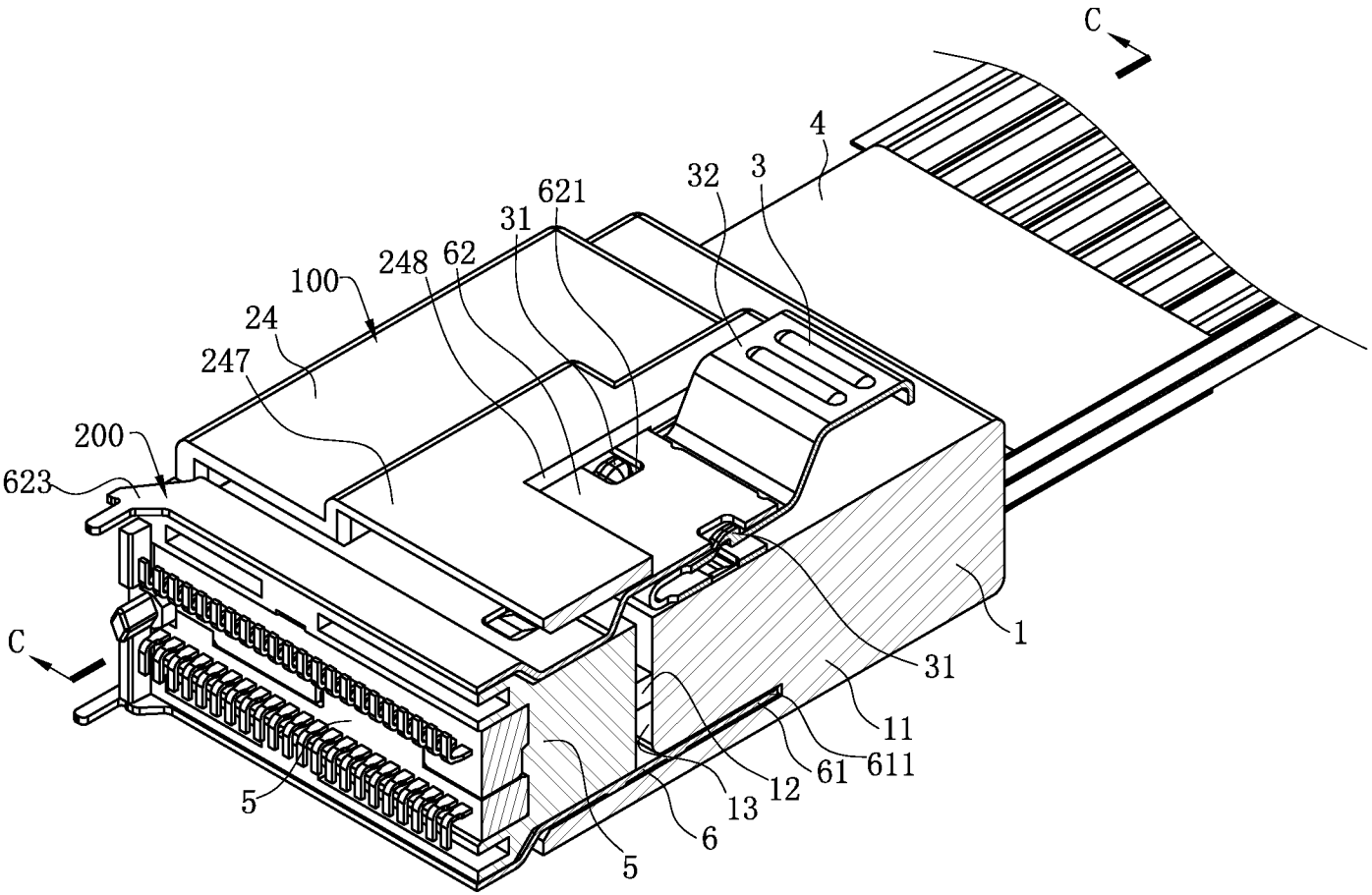
FIG. 18 is a sectional view of FIG. 17.
Figure 19:
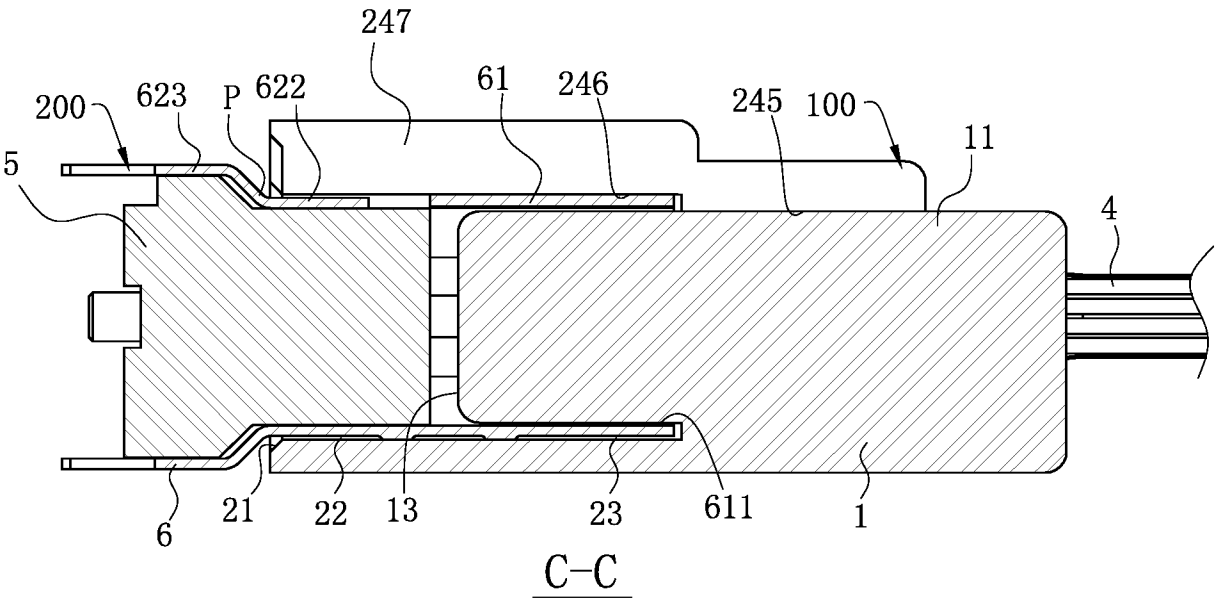
FIG. 19 is a sectional view of FIG. 18 along C-C.
Figure 20:
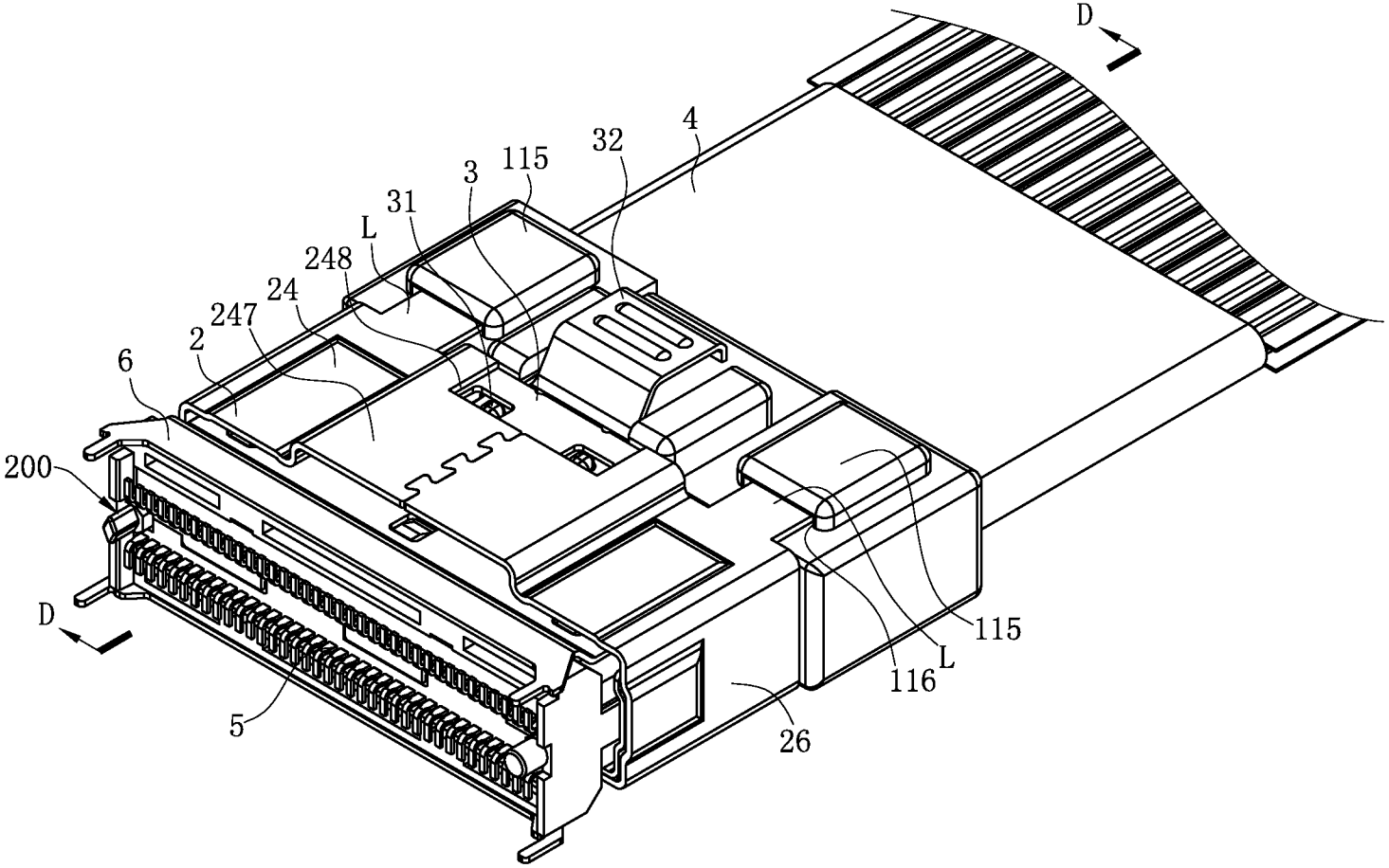
FIG. 20 is a schematic three-dimensional view of an electrical connector assembly according to a seventh embodiment of the present invention.
Figure 21:
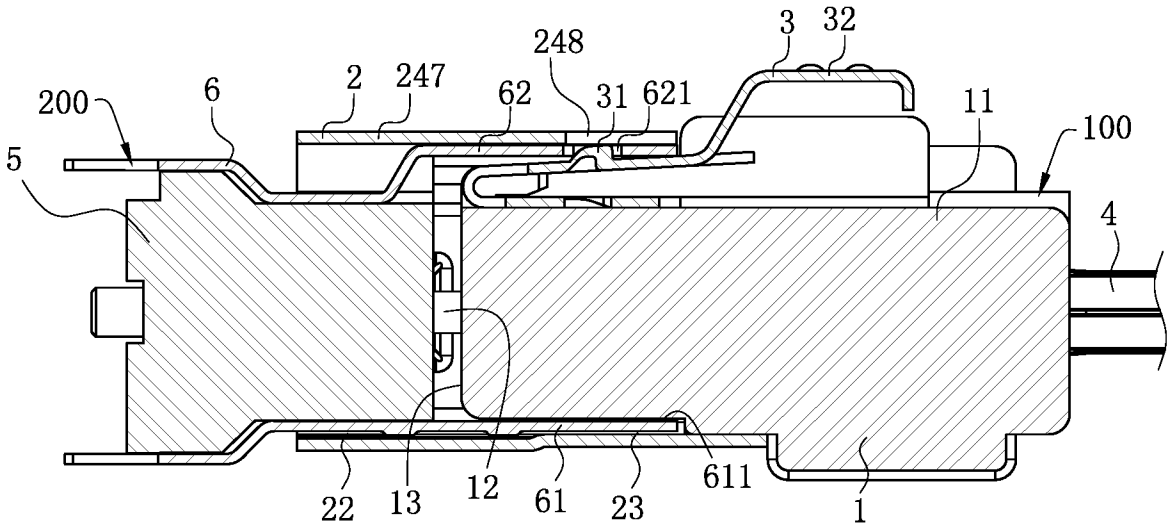
FIG. 21 is a sectional view of FIG. 20 along D-D.
Figure 22:
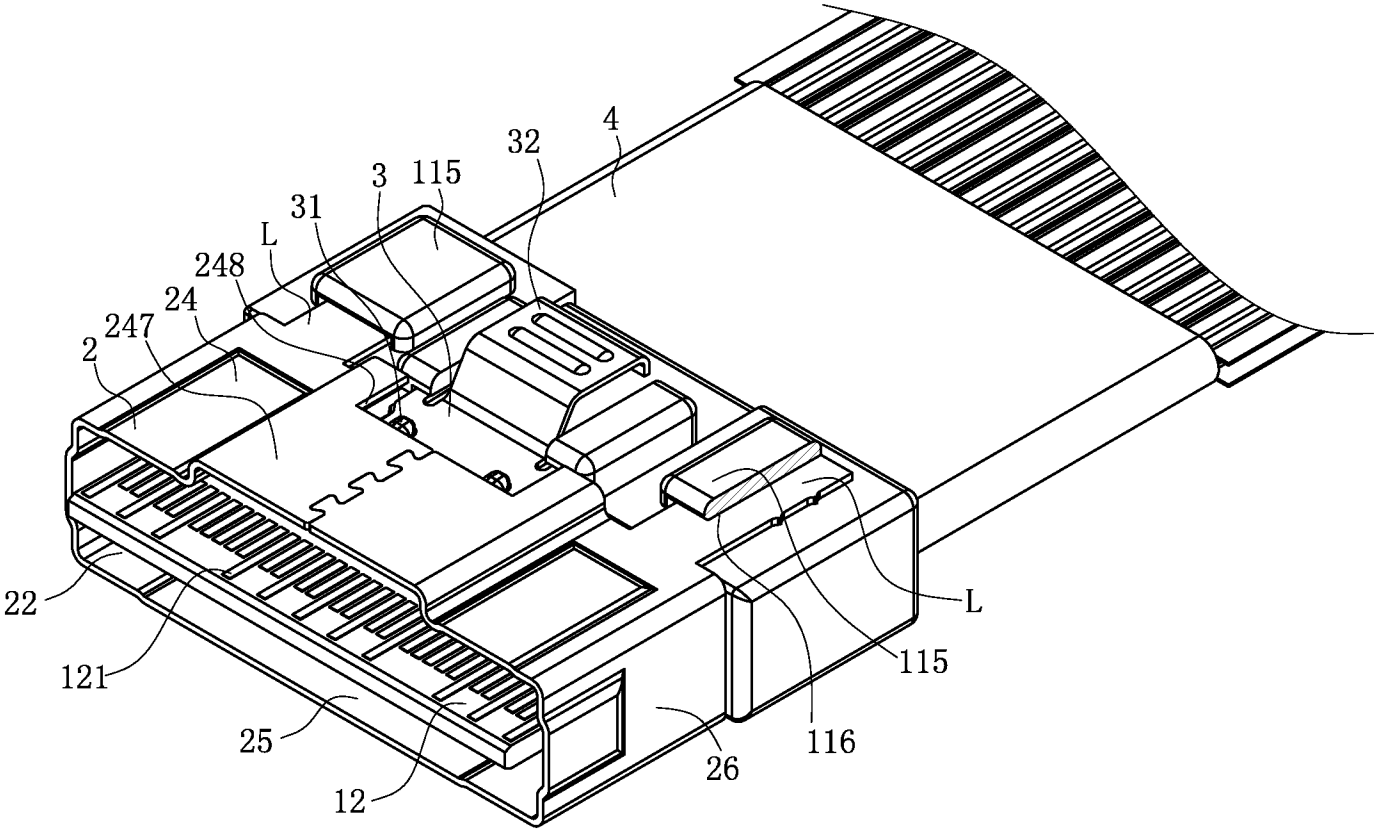
FIG. 22 is schematic three-dimensional assembly view of the electrical connector in FIG. 20.
Figure 23:
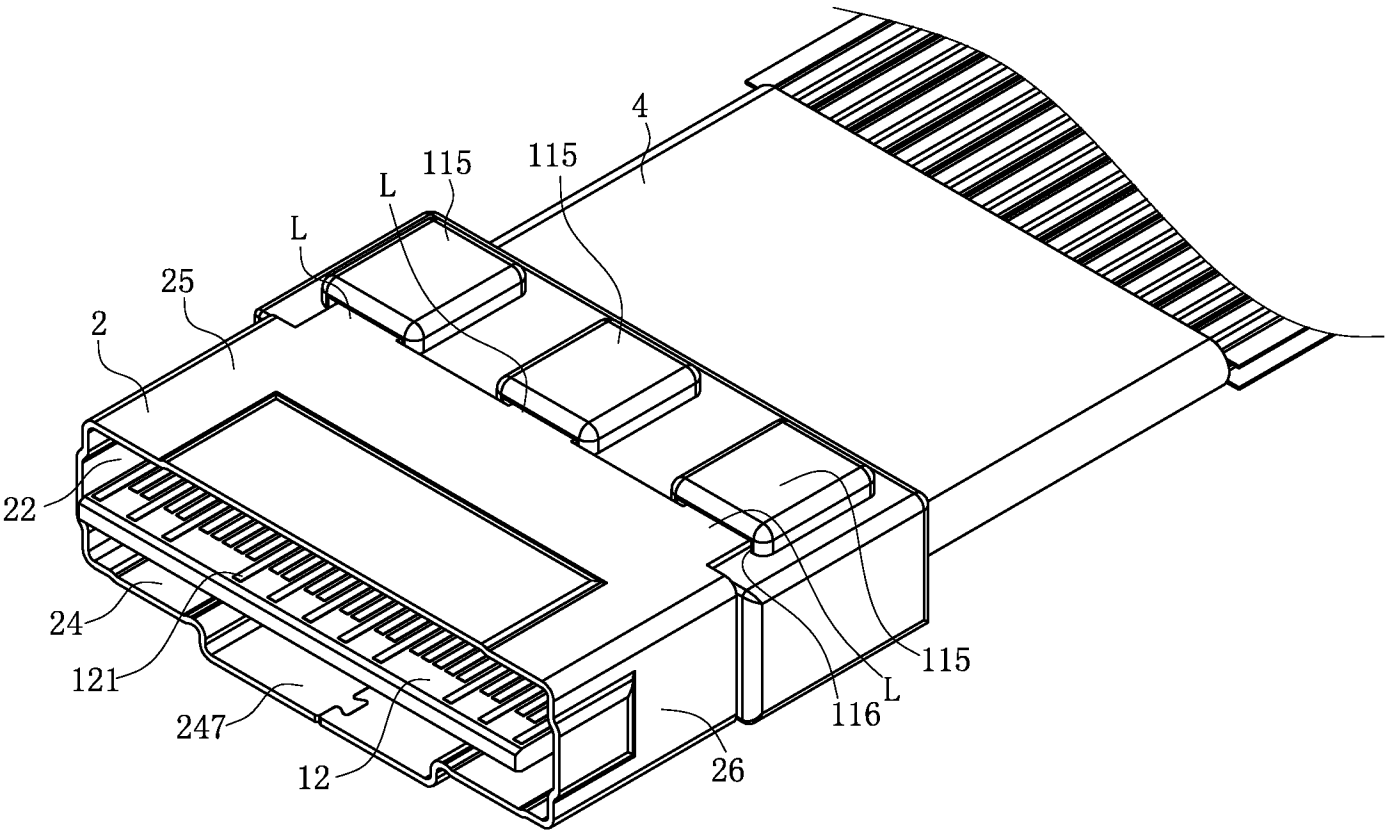
FIG. 23 is a schematic view of FIG. 22 with a 180° inversion.
Figure 24:
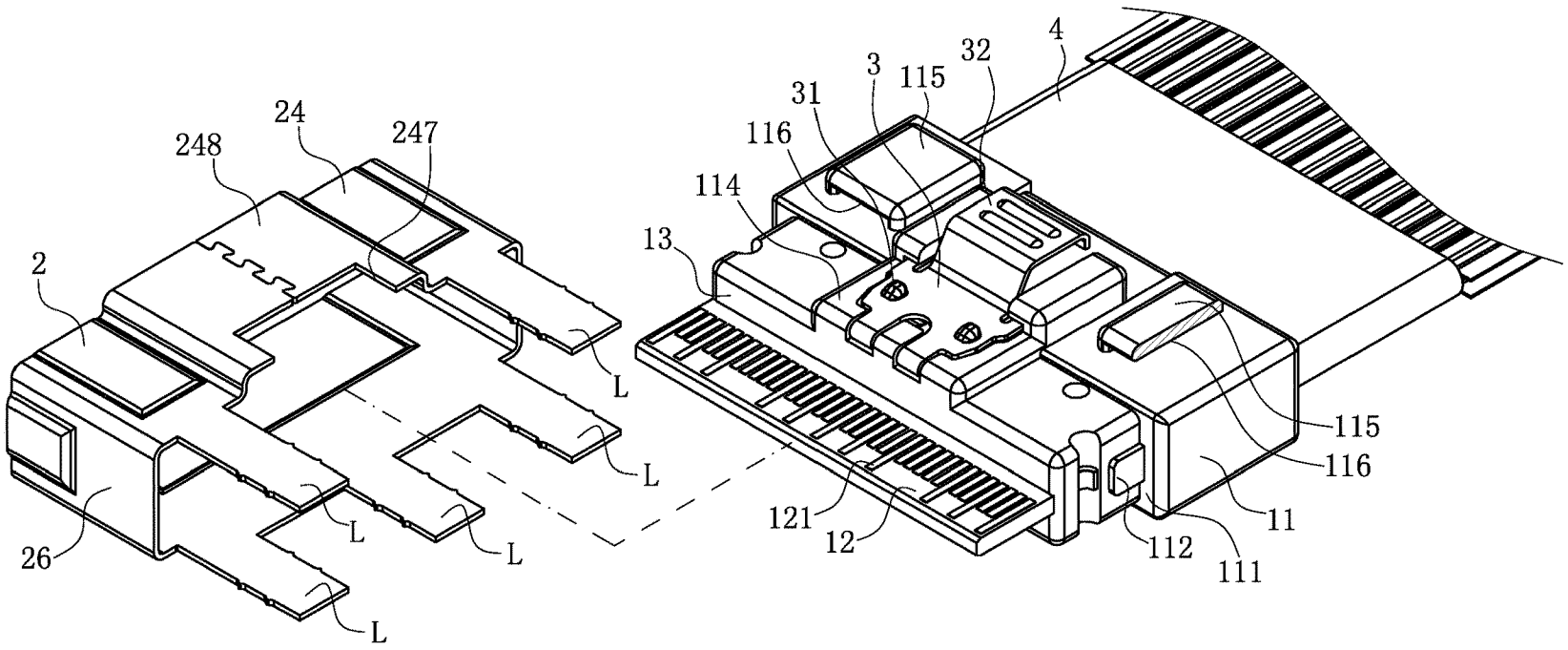
FIG. 24 is a schematic three-dimensional exploded view of the electrical connector in FIG. 22.

FIGS. 17-19 show an electrical connector 100 according to a sixth embodiment of the present invention. A difference from the first embodiment is mainly that: the assisting member 2 and the main body 11 are injection molded, and a capping portion 247 is protruded from the assisting member 2 upward to cover the top surface of the protruding portion 62, so as to guide the insertion of the protrusion portion 62 of the metal shell 6. A notch 248 is disposed at the rear end of the capping portion 247 to expose the latch portion 31, such that it is convenient to observe the latch status between the latch portion 31 and the buckling hole 621.

FIGS. 20-24 show an electrical connector 100 according to a seventh embodiment of the present invention. A difference from the first embodiment is mainly that: the assisting member 2 is made of metal material and is assembled to the main body 11 to increase strength of the assisting member 2. There is no guiding surface 21 disposed at the front end of the assisting member 2. A capping portion 247 is protruded from the assisting member 2 upward to cover the top surface of the protruding portion 62, so as to guide the insertion of the protrusion portion 62 of the metal shell 6. A notch 248 is disposed at the rear end of the capping portion 247 to expose the latch portion 31, such that it is convenient to observe the latch status between the latch portion 31 and the buckling hole 621. Both a top wall 24 and a bottom wall 25 of the assisting member 2 extend backward horizontally to form multiple extending arms L. In other embodiments, the extending arms may also be formed by extending backward horizontally from two side walls 26 of the assisting member 2. The main body 11 is correspondingly provided with multiple protruding blocks 115 covering the extending arms L. Each of the protruding blocks 115 is recessed with a receiving slot 116 for receiving corresponding one of the extending arms L. The receiving slot 116 penetrate the corresponding protruding block 115 along a front-rear direction, and two sides of the extending arm L is posited at two opposite sides of the receiving slot 116, so as to position the assisting member 2 on the insulating body 1.

In summary, the electrical connector and the electrical connector assembly according to certain embodiments of the present invention have the following beneficial advantages.

(1) The guiding surface 21 is arranged at the front end of the assisting member 2 to guide the mating connector 200, so that scratches and damages to the conductors 121 and the socket 5 caused by inaccurate alignment of the mating portion 12 of the electrical connector 100 can be effectively reduced, not only is service life of the electrical connector 100 prolonged, but also mating performance of the electrical connector assembly is improved, and the electrical connector assembly is more consistent with a requirement of a user.

(2) The latch portions 31 are exposed from the open hole 241, so that a latching condition of the latch portions 31 and the buckling holes 621 can be conveniently observed.

(3) The covering portion 244 upwards covers the pressing portion 32, so that the covering portion 244 not only prevents the pressing portion 32 from being pressed to be easily separated by external force, but also increases a pressing area to facilitate operation and improve user experiences.

(4) The notch 2441 is formed between the two covering portions 244, the notch 2441 extends to the front and rear ends of the two covering portions 244, and the notch 2441 improves the elasticity of the two covering portions 244, so that the two covering portions 244 can be prevented from fatigue damage after being repeatedly used for many times, and service life of the assisting member 2 is prolonged.

(5) The blocking portions 261 of the assisting member 2 are stopped by virtue of the stopping surfaces 111 configured to stop the socket 5, so that the assisting member 2 can be fixed without changing a structure of the insulating body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

an electrical connector, comprising:

an insulating body, having a main body and a mating portion protruding forward from a front end of the main body, wherein an upper surface of the main body is higher than an upper surface of the mating portion, such that a front end of the main body forms an interface;

a plurality of conductors received in the mating portion; and an assisting member, covering the main body and the mating portion, wherein the assisting member has a top wall and two opposite sidewalls connected to the top wall;

a mating connector mutually inserted with the electrical connector, comprising a socket and a metal shell covering the socket, wherein an insertion end of the metal shell is protruded from the socket along an insertion direction thereof, and an opening is formed in the insertion end of the metal shell; and a metal latch member arranged on the main body, wherein the metal latch member is protruded with a latch portion for latching the metal shell, and the top wall of the assisting member is provided with an open hole exposing the latch portion, wherein the interface is positioned behind the socket, and the mating portion is smaller than the opening; and wherein a front end of the assisting member guides insertion of the insertion end of the metal shell, a receiving space is formed between the assisting member and the mating portion to receive the socket, and an accommodation space is formed between the assisting member and the main body to receive the metal shell only.

2. The electrical connector assembly of claim 1, wherein the assisting member is made of a plastic material, and is assembled on the main body or is injection molded with the main body; and wherein a guiding surface is arranged at the front end of the assisting member to guide the insertion of the insertion end, an inner surface of the assisting member is provided with a first surface and a second surface that are arranged stepwise, the first surface is in contact with the main body, and the accommodation space is formed between the second surface and the main body.

3. The electrical connector assembly of claim 1, wherein the assisting member is made of a metal material, and extends backward horizontally to form at least one extending arm, the main body is correspondingly disposed with at least one protruding block covering the at least one extending arm, the at least one protruding block is recessed with a receiving slot for receiving the at least one extending arm, and two opposite sides of the at least one extending arm are positioned respectively at two opposite sides of the receiving slot.

4. The electrical connector assembly of claim 1, wherein the electrical connector further comprises a metal latch member disposed on the main body, the metal latch member is protruded with a latch portion, a projection portion is protruded from an upper surface of the metal shell, the projection portion is provided with a buckling hole for latching the latch portion, a capping portion is protruded from the assisting member upward for covering a top surface of the projecting portion, and a notch is disposed at a rear end of the capping portion to expose the latch portion.

5. The electrical connector assembly of claim 1, wherein a plurality of cables are arranged at a rear end of the main body, rear end of each sidewall or the top wall extends backward to form a hook portion, and the hook portion is hooked and buckled to the rear end of the main body.

6. The electrical connector assembly of claim 1, wherein the assisting member further has a bottom wall opposite to the top wall, and the two opposite sidewalls connect the top wall with the bottom wall.

7. The electrical connector assembly of claim 1, wherein a projecting portion is protruded from an upper surface of the metal shell, the projecting portion is provided with a buckling hole configured to latch the latch portion, two opposite side edges of the open hole are positioned on two opposite sides of the projecting portion, and a guide portion is arranged at a front end of the open hole to guide the projecting portion to enter the open hole to be further latched with the metal latch member.

8. The electrical connector assembly of claim 7, wherein a front end of the mating portion protrudes forward out of the front end of the assisting member, the projecting portion bends downward and extends backward to form a first urging portion, the first urging portion bends upward and extends backward to form a second urging portion, the first urging portion and the second urging portion urge an upper surface of the socket, and the front end of the assisting member is stopped at a bending portion where the second urging portion is connected with the first urging portion.

9. The electrical connector assembly of claim 1, wherein the metal latch member is provided with a pressing portion that is upward suspended over the insulating body, the open hole penetrates through front and rear ends of the top wall, the two opposite side edges of the open hole extend upward to form two connecting portions, at least one covering portion is connected with at least one of the two connecting portions, and the at least one covering portion covers upward the pressing portion.

10. The electrical connector assembly of claim 9, wherein the at least one covering portion comprises two covering portions respectively connected with the two connecting portions, a notch is formed between the two covering portions, and the notch extends to front and rear ends of the two covering portions.

11. The electrical connector assembly of claim 9, wherein the two opposite side edges of the open hole extend upward toward opposite directions to form the two connecting portions.

12. The electrical connector assembly of claim 1, wherein a stopping surface is arranged on each of two opposite sides of the main body to stop the insertion end of the metal shell, a positioning block protrudes forward and extends from each stopping surface, the insertion end of the metal shell is recessed with two recesses, the two positioning blocks are buckled to the two recesses respectively, the assisting member is provided with two opposite sidewalls, a blocking portion is arranged on an inner surface of each sidewall, and the blocking portions are stopped at the stopping surfaces.

13. The electrical connector assembly of claim 12, wherein a rear end of each blocking portion is recessed with a positioning slot, and the positioning blocks are engaged with the positioning slots.

14. An electrical connector for mating with a mating connector, the mating connector comprising a socket and a metal shell covering the socket, the electrical connector comprising:

an insulating body having a main body and a mating portion protruding forward from a front end of the main body, wherein an upper surface of the main body is higher than an upper surface of the mating portion, such that a front end of the main body forms an interface;

a metal latch member, mounted on the main body and provided with a latch portion for latching the metal shell;

a plurality of conductors, received in the mating portion;

a plurality of cables, protruding backward from a rear end of the main body and electrically connecting with the conductors; and an assisting plastic member, covering the main body and the mating portion, wherein the assisting plastic member is not movable relative to the insulating body and is fixed to the main body;

wherein a guiding surface for guiding the metal shell is arranged at a front end of the assisting plastic member, a receiving space is formed between the assisting plastic member and the mating portion to receive the socket, an inner surface of the assisting plastic member is provided with a first surface and a second surface that are arranged stepwise, the first surface is in contact with the main body, an accommodation space for receiving the metal shell only is formed between the second surface and the main body, and the receiving space and the accommodation space are positioned on front and rear sides of the interface.

15. The electrical connector of claim 14, wherein a stopping surface for stopping an insertion end of the metal shell is arranged on each of two opposite sides of the main body, a positioning block for buckling the metal shell protrudes forward and extends from each stopping surface, and the assisting plastic member is provided with two opposite sidewalls, a blocking portion is arranged on an inner surface of each sidewall, and the blocking portions are stopped at the stopping surfaces.

16. The electrical connector of claim 14, wherein a rear end of the assisting plastic member extends backward to form a hook portion, and the hook portion is hooked and buckled to the rear end of the main body.

17. The electrical connector of claim 14, wherein a projection portion is protruded from an upper surface of the metal shell, the projection portion is provided with a buckling hole for latching the latch portion, a capping portion is protruded from the assisting plastic member upward for covering a top surface of the projecting portion, and a notch is disposed at the rear end of the capping portion to expose the latch portion.

18. The electrical connector of claim 14, wherein the assisting plastic member has a top wall and a bottom wall that are arranged opposite to each other, and two opposite sidewalls connecting the top wall with the bottom wall, and the top wall is provided with an open hole exposing the latch portion.

19. The electrical connector of claim 18, wherein a protruding portion is protruded from the upper surface of the main body, the metal latch member is mounted on the protruding portion, two opposite side edges of the open hole are positioned on two opposite sides of the protruding portion, and a guide portion is arranged at a front end of the open hole.

20. The electrical connector of claim 18, wherein the metal latch member is provided with a pressing portion that is upward suspended over the insulating body, the open hole penetrates through front and rear ends of the top wall, the two opposite side edges of the open hole extend upward to form two connecting portions, at least one covering portion is connected with at least one of the two connecting portions, and the at least one covering portion upward covers the pressing portion.

21. The electrical connector of claim 20, wherein the at least one covering portion comprises two covering portions respectively connected with the two connecting portions, a notch is formed between the two covering portions, and the notch extends to front and rear ends of the two covering portions.

22. The electrical connector of claim 20, wherein the two opposite side edges of the open hole extend upward toward opposite directions to form the two connecting portions.

23. An electrical connector for mating with a mating connector, the mating connector comprising a socket and a metal shell covering the socket, the electrical connector comprising:

an insulating body having a main body and a mating portion protruding forward from a front end of the main body, wherein an upper surface of the main body is higher than an upper surface of the mating portion, such that a front end of the main body forms an interface;

a metal latch member, mounted on the main body and provided with a latch portion for latching the metal shell;

a plurality of conductors, received in the mating portion;

a plurality of cables, protruding backward from a rear end of the main body and electrically connecting with the conductors; and an assisting plastic member, covering the main body and the mating portion, wherein the assisting member has a top wall and two opposite sidewalls connected to the top wall, and the top wall is provided with an open hole exposing the latch portion;

wherein a guiding surface for guiding the metal shell is arranged at a front end of the assisting plastic member, a receiving space is formed between the assisting plastic member and the mating portion to receive the socket, an inner surface of the assisting plastic member is provided with a first surface and a second surface that are arranged stepwise, the first surface is in contact with the main body, an accommodation space for receiving the metal shell only is formed between the second surface and the main body, and the receiving space and the accommodation space are positioned on front and rear sides of the interface.

* * * * *